US012303745B2

(12) United States Patent
Watanabe

(10) Patent No.: US 12,303,745 B2
(45) Date of Patent: May 20, 2025

(54) MULTI-PIECE SOLID GOLF BALL

(71) Applicant: BRIDGESTONE SPORTS CO., LTD., Tokyo (JP)

(72) Inventor: Hideo Watanabe, Saitamaken (JP)

(73) Assignee: BRIDGESTONE SPORTS CO., LTD., Tokyo (JP)

( * ) Notice: Subject to any disclaimer, the term of this patent is extended or adjusted under 35 U.S.C. 154(b) by 53 days.

(21) Appl. No.: 18/482,467

(22) Filed: Oct. 6, 2023

(65) Prior Publication Data

US 2024/0131400 A1 Apr. 25, 2024
US 2024/0226665 A9 Jul. 11, 2024

(30) Foreign Application Priority Data

Oct. 19, 2022 (JP) ..... 2022-167552

(51) Int. Cl.
*A63B 37/06* (2006.01)
*A63B 37/00* (2006.01)

(52) U.S. Cl.
CPC .... *A63B 37/00221* (2020.08); *A63B 37/0019* (2013.01); *A63B 37/0031* (2013.01); *A63B 37/0044* (2013.01); *A63B 37/0078* (2013.01); *A63B 37/0083* (2013.01); *A63B 37/06* (2013.01)

(58) Field of Classification Search
CPC ..... A63B 37/0063; A63B 37/0062
See application file for complete search history.

(56) References Cited

U.S. PATENT DOCUMENTS

| | | | |
|---|---|---|---|
| 2004/0142770 | A1 | 7/2004 | Watanabe |
| 2011/0143861 | A1 | 6/2011 | Watanabe et al. |
| 2016/0175660 | A1 | 6/2016 | Watanabe et al. |
| 2016/0354644 | A1 | 12/2016 | Watanabe et al. |
| 2016/0361605 | A1 | 12/2016 | Watanabe et al. |
| 2018/0304122 | A1 | 10/2018 | Watanabe et al. |
| 2019/0351293 | A1 | 11/2019 | Watanabe et al. |
| 2020/0330829 | A1 | 10/2020 | Watanabe |

FOREIGN PATENT DOCUMENTS

| | | | |
|---|---|---|---|
| JP | 2004-97802 | A | 4/2004 |
| JP | 2011-120898 | A | 6/2011 |
| JP | 2016-112308 | A | 6/2016 |
| JP | 2017-183 | A | 1/2017 |
| JP | 2017-470 | A | 1/2017 |
| JP | 2018-183247 | A | 11/2018 |
| JP | 2019-198465 | A | 11/2019 |
| JP | 2020-175021 | A | 10/2020 |

*Primary Examiner* — Raeann Gorden
(74) *Attorney, Agent, or Firm* — Sughrue Mion, PLLC

(57) ABSTRACT

A multi-piece solid golf ball includes a core, an intermediate layer, and a cover, in which the core is formed of a rubber composition, the intermediate layer and the cover are formed of a resin composition, and a specific gravity of the intermediate layer is set to at least 1.05, or a relationship among a core surface hardness, a surface hardness of an intermediate layer-encased sphere, and a ball surface hardness satisfies the following condition:

ball surface hardness<surface hardness of intermediate layer-encased sphere>core surface hardness and the core has a specific cross-sectional hardness profile, thereby to have a superior distance on full shots with clubs from a driver to an iron, good durability on repeated impact, and good controllability in the short game when used by amateur users who are advanced players.

13 Claims, 5 Drawing Sheets

MULTI-PIECE SOLID GOLF BALL

CROSS-REFERENCE TO RELATED APPLICATIONS

This non-provisional application claims priority under 35 U.S.C. § 119(a) on Patent Application No. 2022-167552 filed in Japan on Oct. 19, 2022, the entire contents of which are hereby incorporated by reference.

TECHNICAL FIELD

The present invention relates to a multi-piece solid golf ball composed of three or more layers including a core, an intermediate layer, and a cover.

BACKGROUND ART

Many innovations have been made in designing golf balls with a multilayer construction, and many balls that satisfy not only professional golfers but also general amateur golfers from beginners to advanced players have been developed to date. Among them, the most popular golf balls are three-piece solid golf balls composed of a core, an intermediate layer, and a cover (outermost layer). Specifically, there have been many proposals for functional three-piece solid golf balls in which a material hardness and a core surface hardness of each layer of the intermediate layer and the cover, and a surface hardness of an intermediate layer-encased sphere are optimized, and some technologies have been proposed to provide high-performance golf balls by designing a core internal hardness in various aspects while focusing on a core hardness profile occupying most of the volume of the ball.

Examples of such technical documents include the three-piece solid golf balls of the following Patent Documents 1 to 8.

However, although some of the proposed golf balls disclose a relationship between an initial velocity of each of the intermediate layer-encased sphere and each encased sphere of the ball, or a relationship between a deflection when a predetermined load is applied to the core and the deflection when a predetermined load is applied to the ball, none of the proposed golf balls has been invented so as to obtain a superior distance on full shots with clubs from a driver to an iron and to improve a golf ball having controllability on approach shots, a good feel at impact, and excellent striking durability. In particular, there is a demand for a golf ball that can provide a superior distance on full shots with a utility club and an iron for amateur golfers who are advanced players with a low handicap and who place importance on controllability in the short game, although their head speeds are not so high.

CITATION LIST

Patent Document 1: JP-A 2004-97802
Patent Document 2: JP-A 2011-120898
Patent Document 3: JP-A 2016-112308
Patent Document 4: JP-A 2017-183
Patent Document 5: JP-A 2017-470
Patent Document 6: JP-A 2018-183247
Patent Document 7: JP-A 2019-198465
Patent Document 8: JP-A 2020-175021

SUMMARY OF THE INVENTION

The present invention has been made in view of the above circumstances, and an object of the present invention is to provide a golf ball that has a superior distance on full shots with clubs from a driver to an iron, has good controllability on approach shots, and has a good feel at impact and excellent durability on repeated impact when used by amateur users who are advanced players.

As a result of intensive studies to achieve the above object, the inventor of the present invention has found that in a multi-piece solid golf ball including a core, an intermediate layer, and a cover, in a core hardness profile, letting a Shore C hardness at a core center be Cc, the Shore C hardness at a midpoint M between the core center and a core surface be Cm, the Shore C hardnesses at positions 2 mm, 4 mm, and 6 mm inward from the midpoint M be Cm−2, Cm−4, and Cm−6 respectively, the Shore C hardnesses at positions 2 mm, 4 mm, and 6 mm outward from the midpoint M be Cm+2, Cm+4, and Cm+6 respectively, and a Shore C hardness at the core surface be Cs, and defining surface areas A to F as follows:

surface area A: ½×2×(Cm−4−Cm−6)
surface area B: ½×2×(Cm−2−Cm−4)
surface area C: ½×2×(Cm−Cm−2)
surface area D: ½×2×(Cm+2−Cm)
surface area E: ½×2×(Cm+4−Cm+2)
surface area F: ½×2×(Cm+6−Cm+4)

the following condition is satisfied:

$$(\text{surface area } E+\text{surface area } F)-(\text{surface area } A+\text{surface area } B)\geq 3.0$$

and letting a deflection (mm) when the core is compressed under a final load of 1,275 N (130 kgf) from an initial load of 98 N (10 kgf) be C (mm), the following two conditions are satisfied:

$$Cs-Cc\geq 28.0$$

$$C\times(Cs-Cc)\geq 132.0$$

and where a specific gravity of the intermediate layer is set to at least 1.05, or a relationship between a core surface hardness, a surface hardness of an intermediate layer-encased sphere, and a ball surface hardness satisfies the following condition:

$$\text{ball surface hardness}<\text{surface hardness of intermediate layer-encased sphere}>\text{core surface hardness},$$

it is possible to obtain an advantageous distance on full shots with clubs from a driver to an iron, good controllability on approach shots, good feel at impact, and excellent durability on repeated impact when used by amateur users who are advanced players. Thus, the inventor has completed the present invention.

It is noted that the "amateur users who are advanced players" described above are amateur golfers with a low handicap who place importance on controllability in the short game, although their head speeds are not as high as those of professional golfers. The head speed of such a golfer on shots with a driver (W #1) is in the region of approximately 35 to 44 m/s.

Accordingly, the present invention provides a multi-piece solid golf ball.

A multi-piece solid golf ball including a core, an intermediate layer, and a cover, wherein the core is formed of a rubber composition in a single layer or a plurality of layers, the intermediate layer and the cover are both formed of a resin composition, the specific gravity of the intermediate layer is at least 1.05, and the core has a hardness profile in which, letting the Shore C hardness at the core center be Cc, the Shore C hardness at the midpoint M between the core center and the core surface be $C_m$, respective Shore C hardnesses at positions 2 mm, 4 mm, and 6 mm inward from the midpoint M be Cm−2, Cm−4, and Cm−6, respective Shore C hardnesses at positions 2 mm, 4 mm, and 6 mm outward from the midpoint M be Cm+2, Cm+4, and Cm+6, and the Shore C hardness at the core surface be Cs, and defining the surface areas A to F as follows:

surface area A: ½×2×(Cm−4−Cm−6)
surface area B: ½×2×(Cm−2−Cm−4)
surface area C: ½×2×(Cm−Cm−2)
surface area D: ½×2×(Cm+2−Cm)
surface area E: ½×2×(Cm+4−Cm+2)
surface area F: ½×2×(Cm+6−Cm+4)
the following condition is satisfied:

(surface area $E$+surface area $F$)−(surface area $A$+surface area $B$)≥3.0 and letting the deflection (mm) when the core is compressed under a final load of 1,275 N (130 kgf) from an initial load of 98 N (10 kgf) be C (mm), the following two conditions are satisfied:

$$Cs-Cc \geq 28.0$$

$$C \times (Cs-Cc) \geq 132.0.$$

In a preferred embodiment of the multi-piece solid golf ball according to the invention, the following condition is satisfied:

$$(Cs-Cc)/(Cm-Cc) \geq 4.0.$$

In another preferred embodiment of the inventive golf ball, letting the deflection (mm) when the ball is compressed under a final load of 1,275 N (130 kgf) from an initial load of 98 N (10 kgf) be B (mm), the following two conditions are satisfied:

$$B \geq 2.80$$

$$C-B \geq 1.00.$$

In yet another preferred embodiment, a relationship between a core surface hardness, a surface hardness of a sphere (intermediate layer-encased sphere) in which the core is encased with the intermediate layer, and a surface hardness of a sphere (ball) in which the intermediate layer-encased sphere is encased with the cover satisfies the following condition:

ball surface hardness<surface hardness of intermediate layer-encased sphere>core surface hardness (where the surface hardness of each sphere means Shore C hardness).

In still another preferred embodiment, the resin composition of the intermediate layer contains a high-acid ionomer resin having an acid content of at least 16 wt %.

In a further preferred embodiment, the intermediate layer contains an inorganic particulate filler.

In a yet further preferred embodiment, a difference between a specific gravity of the cover and the specific gravity of the intermediate layer is not more than 0.15, and a difference between the specific gravity of the intermediate layer and a specific gravity of the core is not more than 0.15.

In a still further preferred embodiment, the following condition is satisfied:

cover thickness<intermediate layer thickness.

In another preferred embodiment, the core is formed of a rubber composition containing the following components (A) to (E):

(A) a base rubber,
(B) an organic peroxide,
(C) water or a monocarboxylic acid metal salt,
(D) sulfur, and
(E) an organosulfur compound.

In yet another preferred embodiment, a content ratio of the components (D) and (C) is 0.005 to 0.200 in a weight ratio of (D)/(C).

In still another preferred embodiment, a relationship between an initial velocity of the entire core, an initial velocity of a sphere (intermediate layer-encased sphere) in which the core is encased with the intermediate layer, and an initial velocity of a sphere (ball) in which the intermediate layer-encased sphere is encased with the cover satisfies the following two conditions:

(initial velocity of ball)<(initial velocity of intermediate layer-encased sphere)

0.65≤(initial velocity of intermediate layer-encased sphere)−(initial velocity of entire core)≤0.98 (m/s).

In a further preferred embodiment, a multi-piece solid golf ball includes a core, an intermediate layer, and a cover, wherein the core is formed of a rubber composition into a single layer or a plurality of layers, the intermediate layer and the cover are both formed of a resin composition, and a relationship between a core surface hardness, a surface hardness of a sphere (intermediate layer-encased sphere) obtained by encasing the core with the intermediate layer, and a surface hardness of a sphere (ball) obtained by encasing the intermediate layer-encased sphere with the cover satisfies the following condition:

ball surface hardness<surface hardness of intermediate layer-encased sphere>core surface hardness (where the surface hardness of each sphere means Shore C hardness)

and where the core has a hardness profile in which, letting a Shore C hardness at a core center be Cc, a Shore C hardness at a midpoint M between the core center and a core surface be $C_m$, respective Shore C hardnesses at positions 2 mm, 4 mm, and 6 mm inward from the midpoint M be Cm−2, Cm−4, and Cm−6, respective Shore C hardnesses at positions 2 mm, 4 mm, and 6 mm outward from the midpoint M be Cm+2, Cm+4, and Cm+6, and a Shore C hardness at the core surface be Cs, and defining surface areas A to F as follows:

surface area A: ½×2×(Cm−4−Cm−6)
surface area B: ½×2×(Cm−2−Cm−4)
surface area C: ½×2×(Cm−Cm−2)
surface area D: ½×2×(Cm+2−Cm)
surface area E: ½×2×(Cm+4−Cm+2)
surface area F: ½×2×(Cm+6−Cm+4)
the following condition is satisfied:

(surface area $E$+surface area $F$)−(surface area $A$+surface area $B$)≥3.0 and letting a deflection (mm) when the core is compressed under a final load of 1,275 N (130 kgf) from an initial load of 98 N (10 kgf) be C (mm), the following two conditions are satisfied:

$$Cs-Cc \geq 28.0$$

$$C \times (Cs-Cc) \geq 132.0.$$

In a still further embodiment, a relationship between an initial velocity of the entire core, an initial velocity of the sphere (intermediate layer-encased sphere) in which the core is encased with the intermediate layer, and an initial velocity of the sphere (ball) in which the intermediate layer-encased sphere is encased with the cover satisfies the following two conditions:

(initial velocity of ball)<(initial velocity of intermediate layer-encased sphere)

0.65≤(initial velocity of intermediate layer-encased sphere)−(initial velocity of entire core)≤0.98 (m/s).

Advantageous Effects of the Invention

With the golf ball according to the present invention, mainly in amateur golfers who are advanced players with a low handicap, although their head speeds are not so high, a superior distance may be obtained on full shots with clubs from a driver to an iron, a spin rate on approach shots is high, and playability in the short game is excellent. Furthermore, on all shots, the golf ball of the present invention gives a soft feel and a good feel at impact, and has good durability on repeated impact.

DETAILED DESCRIPTION OF THE INVENTION

Hereinafter, the present invention is described in more detail.

Figure 1:
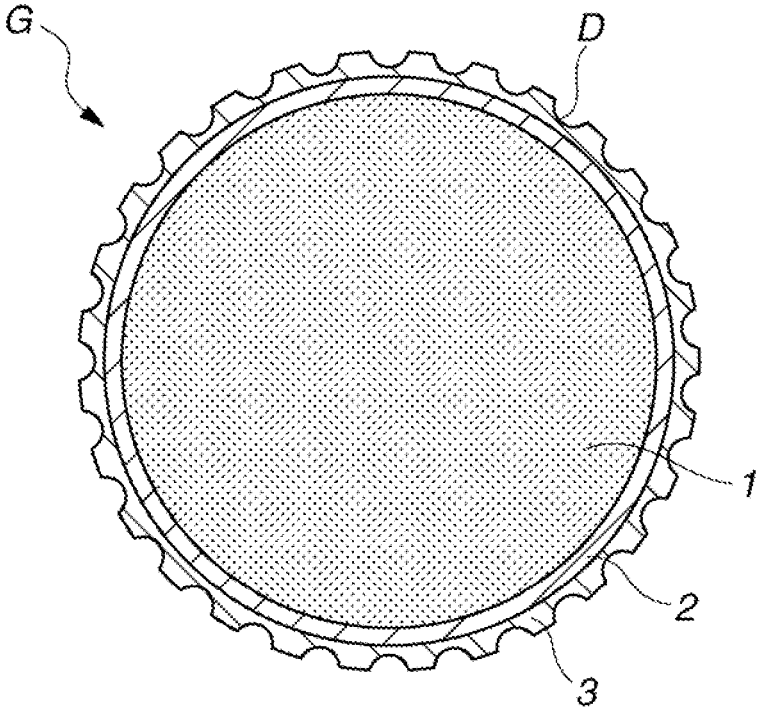
FIG. 1 is a schematic cross-sectional view of a golf ball according to one embodiment of the present invention.

A multi-piece solid golf ball according to the present invention has a core, an intermediate layer, and a cover, and an example thereof is shown in FIG. 1, for example. A golf ball G shown in FIG. 1 has a single-layer core 1, a single-layer intermediate layer 2 encasing the core 1, and a single-layer cover 3 encasing the intermediate layer. The cover 3 is positioned at the outermost layer in the layer construction of the golf ball except for the coating layer. In addition to a single layer as shown in FIG. 1, the core may be formed as a plurality of layers. Each layer of the intermediate layer and the cover is formed of a single layer. A large number of dimples D are typically formed on the surface of the cover (outermost layer) 3 in order to improve the aerodynamic properties of the ball. In addition, although not particularly illustrated, a coating layer is typically formed on the surface of the cover 3. Hereinafter, each of the above layers is described in detail.

The core is obtained by vulcanizing a rubber composition containing a rubber material as a chief material. If the core material is not a rubber composition, a rebound of the core becomes low, and a desired distance may not be obtained on shots by amateur golfers. This rubber composition typically contains a base rubber as a chief material, and is obtained with the inclusion of a co-crosslinking agent, a crosslinking initiator, an inert filler, an organosulfur compound, or the like.

In particular, the core is preferably formed of a rubber composition containing the following components (A) to (E):

(A) a base rubber,
(B) an organic peroxide,
(C) water or a monocarboxylic acid metal salt,
(D) sulfur, and
(E) an organosulfur compound.

As the base rubber (A), polybutadiene is preferably used. As the type of polybutadiene, a commercially available product may be used, and examples thereof include BR01, BR51, and BR730 (manufactured by JSR Corporation). The proportion of polybutadiene in the base rubber is preferably at least 60 wt %, and more preferably at least 80 wt %. In addition to the polybutadiene, other rubber components are included in the base rubber as long as the effect of the present invention is not impaired. Examples of the rubber component other than the polybutadiene include a polybutadiene other than the polybutadiene described above, and other diene rubbers such as styrene-butadiene rubber, natural rubber, isoprene rubber, and ethylene-propylene-diene rubber.

The organic peroxide (B) is suitably used as a co-crosslinking initiator. Specifically, commercially available organic peroxides may be used, and for example, Percumyl D, Perhexa C-40, Perhexa 3M (all manufactured by NOF Corporation), and Luperco 231XL (manufactured by AtoChem Corporation) may be suitably used. These may be used singly, or two or more may be used in combination. The compounding amount of the organic peroxide is preferably at least 0.1 parts by weight, more preferably at least 0.3 parts by weight, and even more preferably at least 0.5 parts by weight, and the upper limit is preferably not more than 5 parts by weight, more preferably not more than 4 parts by weight, even more preferably not more than 3 parts by weight, and most preferably not more than 2.5 parts by weight per 100 parts by weight of the base rubber. If the compounding amount is too large or too small, it may not be possible to obtain suitable feel at impact, durability, and rebound.

The water (C), although not particularly limited, may be distilled water or tap water, but it is particularly suitable to employ distilled water free of impurities. The compounding amount of the water included per 100 parts by weight of the base rubber is preferably at least 0.1 part by weight, and more preferably at least 0.2 parts by weight, and an upper limit thereof is preferably not more than 2 parts by weight, and more preferably not more than 1 part by weight.

By blending the water or a material containing water as the component (C) directly into the core material, a decomposition of the organic peroxide during the core formulation may be promoted. In addition, it is known that the decomposition efficiency of the organic peroxide in the core-forming rubber composition changes depending on temperature, and the decomposition efficiency increases as the temperature becomes higher than a certain temperature. If the temperature is too high, the amount of decomposed radicals becomes too large, and the radicals are recombined or deactivated. As a result, fewer radicals act effectively in crosslinking. Here, when decomposition heat is generated by the decomposition of the organic peroxide at the time of core vulcanization, a temperature near the core surface is maintained at substantially the same level as a temperature of a vulcanization mold, although the temperature around the core center is considerably higher than the mold temperature due to an accumulation of decomposition heat by the organic peroxide decomposing from the outer side. If the water or the material containing water is directly included in the core, the water acts to promote the decomposition of the organic peroxide, so that the radical reactions as described above may be changed at the core center and the core surface. That is, the decomposition of the organic peroxide is further promoted near the core center, and the deactivation of radicals is further promoted, so that the amount of active radicals is further reduced, and as a result, a core may be obtained in which the crosslink densities at the core center and the core surface differ markedly, and the dynamic viscoelasticity of the core center portion is different.

In addition, a monocarboxylic acid metal salt may be employed instead of the water. In the monocarboxylic acid metal salt, it is presumed that a carboxylic acid is coordinate-bonded to the metal salt, and the monocarboxylic acid metal salt is distinguished from a dicarboxylic acid metal salt such as zinc diacrylate, which is represented by chemical formula $[CH_2{=}CHCOO]_2Zn$. The monocarboxylic acid metal salt brings water into the rubber composition by a dehydration condensation reaction, so that the same effect as that of the water may be obtained. In addition, since the monocarboxylic acid metal salt may be blended into the rubber composition as powder, the working process may be simplified, and it is easy to uniformly disperse the monocarboxylic acid metal salt in the rubber composition. In order to effectively perform the above reaction, it is necessary to use a mono-salt. The compounding amount of the monocarboxylic acid metal salt is preferably at least 1 part by weight, and more preferably at least 3 parts by weight per 100 parts by weight of the base rubber. As an upper limit thereof, the compounding amount of the monocarboxylic acid metal salt is preferably not more than 60 parts by weight, and more preferably not more than 50 parts by weight per 100 parts by weight of the base rubber. If the compounding amount of the monocarboxylic acid metal salt is too small, it is difficult to obtain an appropriate crosslinking density, and it may not be possible to obtain an adequate golf ball spin rate-lowering effect. In addition, if the compounding amount is too large, the core becomes too hard, so that it may be difficult to maintain an appropriate feel at impact.

As the carboxylic acid, an acrylic acid, a methacrylic acid, a maleic acid, a fumaric acid, a stearic acid, or the like may be used. Examples of a substitute metal include Na, K, Li, Zn, Cu, Mg, Ca, Co, Ni, and Pb, and Zn is preferably used. Specific examples thereof include a zinc monoacrylate and a zinc monomethacrylate, and it is particularly preferable to use a zinc monoacrylate.

By using the sulfur (D), a difference between the inner hardness of the core and the outer hardness of the core may be increased. Specific examples of the sulfur (D) include the trade names "SANMIX S-80 N" (manufactured by Sanshin Chemical Industry Co., Ltd.) and "SULFAX® 5" (manufactured by Tsurumi Chemical Industry Co., Ltd.). The compounding amount of the sulfur may be more than 0 parts by weight, preferably at least 0.005 parts by weight, and more preferably at least 0.01 parts by weight per 100 parts by weight of the base rubber. In addition, although not particularly limited, an upper limit of the compounding amount may be preferably not more than 0.1 part by weight, more preferably not more than 0.05 parts by weight, and even more preferably not more than 0.03 parts by weight per 100 parts by weight of the base rubber. If the compounding amount of the sulfur is too large, the rebound may be greatly reduced, or the durability on repeated impact may be reduced.

The organosulfur compound (E) may be blended in order to control the rebound of the core so that it is increased. As the organosulfur compound, specifically, it is recommended to include thiophenol, thionaphthol, halogenated thiophenol, or a metal salt thereof. More specifically, examples of the organosulfur compound include zinc salts such as pentachlorothiophenol, pentafluorothiophenol, pentabromothiophenol, p-chlorothiophenol, and pentachlorothiophenol, and any of the following having 2 to 4 sulfur atoms: diphenylpolysulfide, dibenzylpolysulfide, dibenzoylpolysulfide, dibenzothiazoylpolysulfide, and dithiobenzoylpolysulfide. In particular, diphenyldisulfide and the zinc salt of pentachlorothiophenol may be preferably used.

The organosulfur compound is blended in an amount of not more than 5 parts by weight, preferably not more than 4 parts by weight, more preferably not more than 3 parts by weight, and most preferably not more than 2 parts by weight per 100 parts by weight of the base rubber. If the compounding amount is too large, the core hardness becomes too soft and the rebound of the core becomes too high, so that the distance on shots with a driver may be too long.

The content ratio of the components (D) and (C) in terms of a weight ratio of (D)/(C) is preferably at least 0.005, more preferably at least 0.008, and still more preferably at least 0.010, and an upper limit thereof is preferably not more than 0.200, more preferably not more than 0.100, and still more preferably not more than 0.060. If there is a deviation from the above ranges, it is difficult to achieve the intended core hardness profile, and it may not be possible to achieve both a superior distance due to a low spin rate of the ball on full shots and a good durability on repeated impact. The component (D) means the weight (substantial content) of the sulfur component contained in the product, not the weight of the sulfur product itself.

Examples of a rubber blending component other than the components (A) to (E) include a co-crosslinking agent, an inert filler, and an antioxidant.

The co-crosslinking agent is an $\alpha,\beta$-unsaturated carboxylic acid and/or a metal salt thereof. Specific examples of the unsaturated carboxylic acid include acrylic acid, methacrylic acid, maleic acid, fumaric acid, or the like, and in particular, acrylic acid and methacrylic acid are preferably used. The metal salt of the unsaturated carboxylic acid is not particularly limited, and examples thereof include those obtained by neutralizing the unsaturated carboxylic acid with a desired metal ion. Specific examples thereof include zinc salts and magnesium salts such as methacrylic acid and acrylic acid, and in particular, zinc acrylate is preferably used.

The unsaturated carboxylic acid and/or the metal salt thereof is typically blended in an amount of at least 5 parts by weight, preferably at least 9 parts by weight, and even more preferably at least 13 parts by weight, and the upper limit is typically not more than 60 parts by weight, preferably not more than 50 parts by weight, and even more preferably not more than 40 parts by weight per 100 parts by weight of the base rubber. If the compounding amount is too large, the core may become too hard, giving the ball an unpleasant feel at impact, and if the compounding amount is too small, rebound may become low.

As a filler, for example, zinc oxide, barium sulfate, calcium carbonate, or the like may be suitably used. These may be used singly, or two or more may be used in combination. The compounding amount of the filler is preferably at least 1 part by weight, and more preferably at least 3 parts by weight per 100 parts by weight of the base rubber. In addition, an upper limit of the compounding amount is preferably not more than 50 parts by weight, more preferably not more than 40 parts by weight, and even more preferably not more than 30 parts by weight per 100 parts by weight of the base rubber. If the compounding amount is too large or too small, it may not be possible to obtain an appropriate weight and a suitable rebound.

As an antioxidant, for example, commercially available products such as Nocrac NS-6, Nocrac NS-30, Nocrac NS-200, and Nocrac MB (all manufactured by Ouchi Shinko Chemical Industrial Co., Ltd.) may be employed. These may be used singly, or two or more may be used in combination.

The compounding amount of the antioxidant, although not particularly limited, is preferably at least 0.05 parts by weight, and more preferably at least 0.1 parts by weight, and the upper limit is preferably not more than 1.0 part by weight, more preferably not more than 0.7 parts by weight, and even more preferably not more than 0.5 parts by weight per 100 parts by weight of the base rubber. If the compounding amount is too large or too small, a suitable core hardness gradient cannot be obtained, and it may not be possible to obtain a suitable rebound, durability, and a spin rate-lowering effect on full shots.

The core may be manufactured by vulcanizing and curing the rubber composition containing the above components. For example, a molded body can be manufactured by intensively mixing the rubber composition using a mixing apparatus such as a Banbury mixer or a roll mill, subsequently compression molding or injection molding the mixture using a core mold, and curing the resulting molded body by appropriately heating it at a temperature sufficient for the organic peroxide or the co-crosslinking agent to act, such as at a temperature of 100 to 200° C., and preferably at a temperature of 140 to 180° C., for 10 to 40 minutes.

In the present invention, the core is formed as a single layer or a plurality of layers, and is preferably formed as a single layer. If the rubber core is produced as a plurality of layers of rubber, in a case where a difference in hardness between the interfaces of these rubber layers is large, layer separation at the interfaces may arise when the ball is repeatedly struck, possibly leading to a loss in an initial velocity of the ball on full shots.

A core diameter is preferably at least 36.7 mm, more preferably at least 37.2 mm, and even more preferably at least 37.6 mm. An upper limit of the core diameter is preferably not more than 40.1 mm, more preferably not more than 39.0 mm, and even more preferably not more than 38.2 mm. If the core diameter is too small, the initial velocity of the ball may become low, or a deflection of the entire ball may become small, the spin rate of the ball on full shots rises, and an intended distance may not be attainable. On the other hand, if the core diameter is too large, the spin rate of the ball on full shots may rise, and the intended distance may not be attainable, or a durability to cracking on repeated impact may worsen.

Although not particularly limited, a deflection (mm) when the core is compressed under a final load of 1,275 N (130 kgf) from an initial load of 98 N (10 kgf) is preferably at least 3.8 mm, more preferably at least 4.0 mm, and even more preferably at least 4.2 mm, and an upper limit thereof is preferably not more than 6.0 mm, more preferably not more than 5.4 mm, and even more preferably not more than 5.0 mm. If the deflection of the core is too small, that is, the core is too hard, the spin rate of the ball may rise excessively, and a good distance may not be achieved, or the feel at impact may be excessively hard. On the other hand, if the deflection of the core is too large, that is, the core is too soft, the ball rebound may become too low and a good distance may not be achieved, the feel at impact may be too soft, or the durability to cracking on repeated impact may worsen.

Next, the core hardness profile is described. The hardness of the core described below means Shore C hardness. The Shore C hardness is a hardness value measured with a Shore C durometer conforming to the ASTM D2240 standard.

A core center hardness (Cc) is preferably at least 47, more preferably at least 49, and even more preferably at least 51, and an upper limit thereof is preferably not more than 58, more preferably not more than 56, and even more preferably not more than 54. When this value is too large, the feel at impact becomes hard, or the spin rate of the ball on full shots rises, and the intended distance may not be attainable. On the other hand, when the above value is too small, the rebound becomes low and a good distance is not achieved, or the durability to cracking on repeated impact may worsen.

Although not particularly limited, a hardness (Cm−6) at a position 6 mm inward from a point M (hereinafter, also referred to as "midpoint M") between the core center and the core surface may be preferably at least 48, more preferably at least 50, and even more preferably at least 52, and an upper limit thereof is also not particularly limited, and may be preferably not more than 58, more preferably not more than 56, and even more preferably not more than 54. Hardnesses that deviate from these values may lead to undesirable results similar to those described above for the core center hardness (Cc).

Although not particularly limited, a hardness (Cm−4) at a position 4 mm inward from the midpoint M between the core center and the core surface may be preferably at least 49, more preferably at least 51, and even more preferably at least 53, and an upper limit thereof is also not particularly limited, and may be preferably not more than 59, more preferably not more than 57, and even more preferably not more than 55. Hardnesses that deviate from these values may lead to undesirable results similar to those described above for the core center hardness (Cc).

Although not particularly limited, a hardness (Cm−2) at a position 2 mm inward from the midpoint M of the core may be preferably at least 50, more preferably at least 52, and even more preferably at least 54, and an upper limit thereof is also not particularly limited, and may be preferably not more than 61, more preferably not more than 59, and even more preferably not more than 57. Hardnesses that deviate from these values may lead to undesirable results similar to those described above for the core center hardness (Cc). Hardnesses that deviate from these values may lead to undesirable results similar to those described above for the core center hardness (Cc).

Although not particularly limited, a cross-sectional hardness (Cm) at the midpoint M of the core may be preferably at least 50, more preferably at least 52, and even more preferably at least 54. In addition, although not particularly limited, an upper limit thereof may be preferably not more than 62, more preferably not more than 60, and even more preferably not more than 58. Hardnesses that deviate from these values may lead to undesirable results similar to those described above for the core center hardness (Cc).

A core surface hardness (Cs) is preferably at least 79, more preferably at least 81, and even more preferably at least 83, and an upper limit thereof is preferably not more than 91, more preferably not more than 89, and even more preferably not more than 87. When this value is too large, the durability to cracking on repeated impact may worsen, or the feel at impact may become too hard. On the other hand, when the above value is too small, the rebound becomes low and a good distance is not achieved, or the spin rate of the ball on full shots rises, and the intended distance may not be attainable.

Although not particularly limited, a hardness (Cm+2) at a position 2 mm outward from the midpoint M of the core toward the core surface (hereinafter, simply referred to as "outward") may be preferably at least 53, more preferably at least 55, and even more preferably at least 57, and an upper limit thereof is also not particularly limited, and may be preferably not more than 66, more preferably not more than 63, and even more preferably not more than 60. Hardnesses that deviate from these values may lead to undesirable results similar to those described above for the core surface hardness (Cs).

Although not particularly limited, a hardness (Cm+4) at a position 4 mm outward from the midpoint M of the core may be preferably at least 54, more preferably at least 56, and even more preferably at least 58, and an upper limit thereof is also not particularly limited, and may be preferably not more than 67, more preferably not more than 64, and even more preferably not more than 61. Hardnesses that deviate from these values may lead to undesirable results similar to those described above for the core surface hardness (Cs).

Although not particularly limited, a hardness (Cm+6) at a position 6 mm outward from the midpoint M of the core may be preferably at least 63, more preferably at least 65, and even more preferably at least 67, and an upper limit thereof is also not particularly limited, and may be preferably not more than 74, more preferably not more than 72, and even more preferably not more than 70. Hardnesses that deviate from these values may lead to undesirable results similar to those described above for the core surface hardness (Cs).

Although not particularly limited, a difference between the core surface hardness and the core center hardness (Cs−Cc) is preferably at least 28.0, more preferably at least 30.0, and even more preferably at least 31.0. On the other hand, an upper limit thereof is not particularly limited, and may be preferably not more than 40.0, more preferably not more than 37.0, and still more preferably not more than 35.0. If this value is too small, the spin rate of the ball rises on full shots, and the intended distance may not be attainable. On the other hand, if this value is too large, the durability to cracking on repeated impact may worsen, the rebound becomes low, and the intended distance may not be attainable.

In addition, the core hardness profile preferably satisfies the following condition:

$$(Cs-Cc)/(Cm-Cc) \geq 4.0.$$

The value of (Cs−Cc) indicates the difference in hardness between the core center and the core surface, and the value of (Cm−Cc) indicates the difference in hardness between the core midpoint and the core center, and the above condition means that the difference in hardness from the core midpoint to the core surface is sufficiently larger than the difference in hardness from the core center to the core midpoint. The value of (Cs−Cc)/(Cm−Cc) is preferably at least 4.0, more preferably at least 6.0, and still more preferably at least 8.0, and an upper limit thereof is preferably not more than 16.0, more preferably not more than 14.0, and still more preferably not more than 12.0. If this value is too small, the spin rate of the ball rises on full shots, and the intended distance may not be attainable. On the other hand, if the above value is too large, the durability to cracking on repeated impact may worsen.

Figure 5:
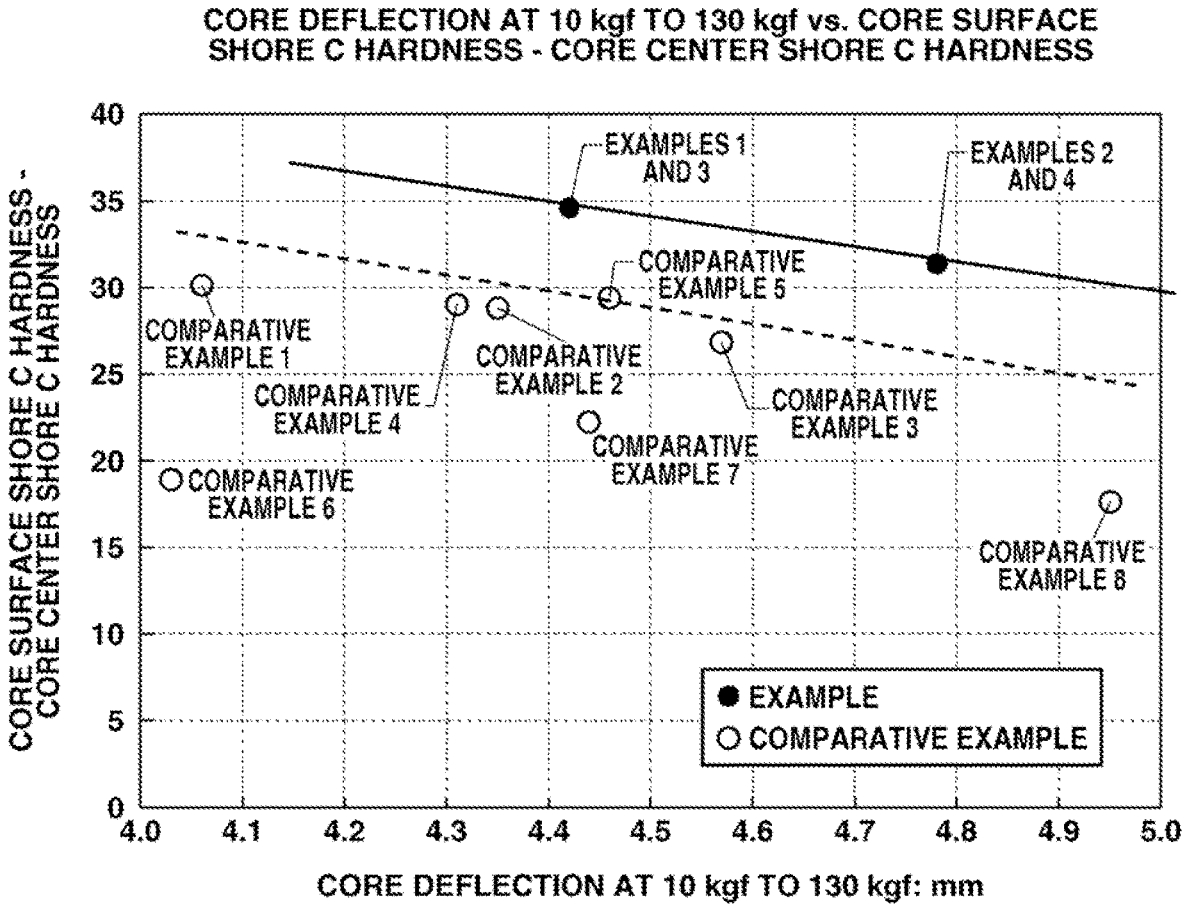
FIG. 5 is a graph showing the relationship between a deflection of the core and the difference in hardness between the core surface and the core center in Examples 1 to 4 and Comparative Examples 1 to 8.

Letting the deflection (mm) when the core is compressed under a final load of 1,275 N (130 kgf) from an initial load of 98 N (10 kgf) be C (mm), a value of C×(Cs−Cc) is preferably at least 132.0, more preferably at least 138.0, and still more preferably at least 145.0, and an upper limit thereof is preferably not more than 200.0, more preferably not more than 180.0, and still more preferably not more than 160.0. The fact that the value of this condition is large means that the deflection of the core when compressed under a predetermined load is large, and a value obtained by subtracting the core center hardness from the core surface hardness is larger than that of a conventional core. Specifically, as shown in FIG. 5, it can be seen that the difference in hardness between the core surface hardness and the core center hardness is sufficiently higher in each Example than in each Comparative Example as long as the deflection at the time of applying the predetermined load is the same in each Example and Comparative Example. If the value of C×(Cs−Cc) is too small, the spin rate of the ball on full shots increases, and the intended distance may not be attainable. On the other hand, if the above value is too large, the durability to cracking on repeated impact worsens, or the rebound becomes lower, and the intended distance may not be attainable.

In the core hardness profile, the surface areas A to F defined as follows:

surface area A: ½×2×(Cm−4−Cm−6)
surface area B: ½×2×(Cm−2−Cm−4)
surface area C: ½×2×(Cm−Cm−2)
surface area D: ½×2×(Cm+2−Cm)
surface area E: ½×2×(Cm+4−Cm+2)
surface area F: ½×2×(Cm+6−Cm+4)

are characterized in that a value of (surface area E+surface area F)−(surface area A+surface area B) is preferably at least 3.0, more preferably at least 4.5, and even more preferably at least 6.0, and an upper limit thereof is preferably not more than 20.0, more preferably not more than 16.0, and even more preferably not more than 10.0. When this value is too large, the durability to cracking on repeated impact may worsen. On the other hand, when this value becomes too small, the spin rate of the ball on full shots may rise, and the intended distance may not be attainable.

In addition, a value of (surface area D+surface area E)−(surface area B+surface area C) is preferably at least 1.0, more preferably at least 2.0, and even more preferably at least 3.0, and an upper limit thereof is preferably not more than 20.0, more preferably not more than 16.0, and even more preferably not more than 10.0. When this value is too large, the durability to cracking on repeated impact may worsen. On the other hand, when this value becomes too small, the spin rate of the ball on full shots may rise, and the intended distance may not be attainable.

Further, the surface areas A to F preferably satisfy the following condition:

$$\text{surface area } C < \text{surface area } D < \text{surface area } F.$$

The surface areas A to F more preferably satisfy the following condition:

$$\text{surface area } B < \text{surface area } D$$

and even more preferably satisfy the following condition:

$$(\text{surface area } A + \text{surface area } B) < (\text{surface area } C + \text{surface area } D) < (\text{surface area } E + \text{surface area } F).$$

If these relationships are not satisfied, the spin rate of the ball on full shots rises, and the intended distance may not be attainable.

Figure 2:
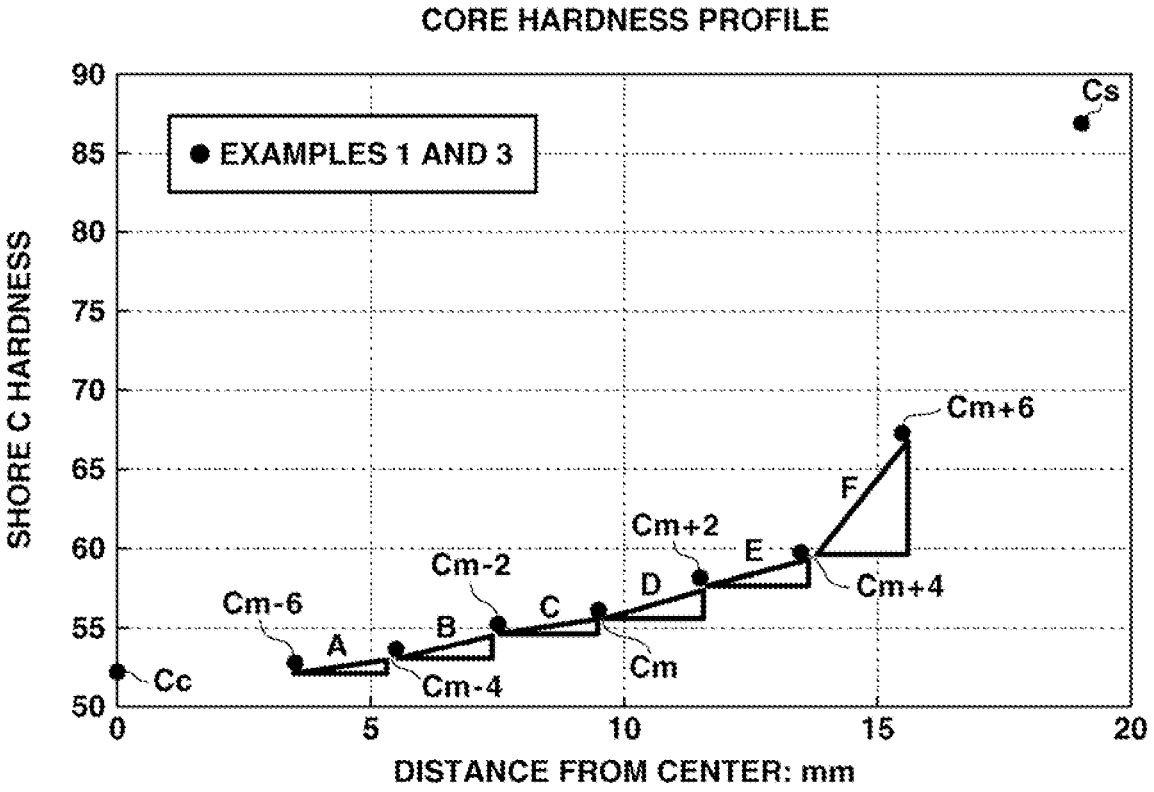
FIG. 2 is a graph that uses core hardness profile data in Examples 1 and 3 to describe surface areas A to F in the core hardness profile.

FIG. 2 shows a graph describing the surface areas A to F using the core hardness profile data of Examples 1 and 3. In this way, the surface areas A to F are surface areas of each triangle whose base is a difference between each specific distance and whose height is a difference in hardness between each position at these specific distances.

An initial velocity of the core is preferably at least 75.8 m/s, more preferably at least 76.3 m/s, and even more preferably at least 76.6 m/s, and an upper limit thereof is preferably not more than 77.5 m/s, more preferably not more than 77.2 m/s, and even more preferably not more than 76.9 m/s. A ball initial velocity that is too high may fall outside the range specified in the Rules of Golf. On the other hand, if the initial velocity of the core becomes too low, the ball rebound on full shots becomes low, or the spin rate of the ball rises, and the intended distance may not be attainable. The value of the initial velocity in this case is a numerical value measured by a device for measuring a coefficient of restitution (COR) (Golf Ball Testing Machine) of the same type as the R&A. Specifically, a Golf Ball Testing Machine manufactured by Hye Precision USA is used. As a condition, at the time of measurement, an air pressure is changed in four stages and measured, a relational expression between an incident velocity and the COR is constructed, and the initial velocity at an incident velocity of 43.83 m/s is determined from the relational expression. It is noted that for a measurement environment of the Golf Ball Testing Machine, a ball temperature-controlled for at least three hours in a thermostatic bath adjusted to 23.9±1° C. is used, and measurement is performed at a room temperature of 23.9±2° C. As for a barrel diameter set at the time of measurement by the Golf Ball Testing Machine, the clearance on one side with respect to the outer diameter of the object for measurement is selected to be between 0.2 mm and 2.0 mm.

Next, the intermediate layer is described.

The intermediate layer has a material hardness on the Shore C hardness scale, although not particularly limited, is preferably at least 90, more preferably at least 92, and even more preferably at least 93, but is preferably not more than 100, more preferably not more than 98, and even more preferably not more than 96. A material hardness on the Shore D hardness scale is preferably at least 64, more preferably at least 66, and even more preferably at least 67, and an upper limit thereof is preferably not more than 75, more preferably not more than 72, and even more preferably not more than 70.

The sphere obtained by encasing the core with the intermediate layer (intermediate layer-encased sphere) has a surface hardness which, on the Shore C hardness scale, is preferably at least 95, more preferably at least 96, and even more preferably at least 97. The upper limit is preferably not more than 100, more preferably not more than 99, and even more preferably not more than 98. The surface hardness on the Shore D hardness scale is preferably at least 68, more preferably at least 69, and even more preferably at least 70. The upper limit is preferably not more than 78, more preferably not more than 75, and even more preferably not more than 72.

If the material hardness and the surface hardness of the intermediate layer are too soft in comparison with the above ranges, the spin rate of the ball on full shots may rise excessively so that the distance may not be increased, or the initial velocity of the ball may become low so that the distance may not be increased. On the other hand, if the material hardness and the surface hardness of the intermediate layer are too hard in comparison with the above ranges, the durability to cracking on repeated impact may worsen, or the feel at impact on shots with a putter or on short approaches may become too hard.

The intermediate layer has a thickness that is preferably at least 1.00 mm, more preferably at least 1.25 mm, and even more preferably at least 1.45 mm. An upper limit of the thickness of the intermediate layer is preferably not more than 1.80 mm, more preferably not more than 1.65 mm, and even more preferably not more than 1.55 mm. It is preferable for the intermediate layer to be thicker than the cover described later. When the intermediate layer thickness falls outside the above range or the intermediate layer is thinner than the cover, the ball spin rate-lowering effect on shots with a driver (W #1) may be inadequate, resulting in a poor distance. Also, if the intermediate layer is too thin, the durability to cracking on repeated impact and a durability at a low temperature may worsen.

A value obtained by subtracting the cover thickness from the intermediate layer thickness is preferably larger than 0 mm, more preferably at least 0.3 mm, and even more preferably at least 0.5 mm, and an upper limit thereof is preferably not more than 1.5 mm, more preferably not more than 1.0 mm, and even more preferably not more than 0.7 mm. If the above value deviates from the above ranges, the spin rate of the ball on full shots rises, an actual initial velocity on shots becomes lower, or the like, and thus, the intended distance may not be attainable. If this value is too small, the durability to cracking on repeated impact may worsen.

As a material of the intermediate layer, it is suitable to employ an ionomer resin as a chief material.

The ionomer resin material preferably contains a high-acid ionomer resin having an unsaturated carboxylic acid content (also referred to as "acid content") of at least 16 wt %.

The amount of high-acid ionomer resin included per 100 wt % of the resin material is preferably at least 20 wt %, more preferably at least 50 wt %, and even more preferably at least 60 wt %. The upper limit is preferably not more than 100 wt %, more preferably not more than 90 wt %, and even more preferably not more than 85 wt %. When the compounding amount of the high-acid ionomer resin is too small, the spin rate of the ball on full shots may rise, and a good distance may not be attained. On the other hand, when the compounding amount of the high-acid ionomer resin is too high, the durability on repeated impact may worsen.

In addition, if an ionomer resin is employed as the chief material, an aspect that uses in admixture a zinc-neutralized ionomer resin and a sodium-neutralized ionomer resin as the chief materials is desirable. The blending ratio in terms of zinc-neutralized ionomer resin/sodium-neutralized ionomer resin (weight ratio) is from 5/95 to 95/5, preferably from 10/90 to 90/10, and more preferably from 15/85 to 85/15. If the zinc-neutralized ionomer and the sodium-neutralized ionomer are not included in this ratio, the rebound may become too low to obtain a desired flight, the durability to cracking on repeated impact at room temperature may worsen, and the durability to cracking at a low temperature (below zero) may worsen.

In the intermediate layer material, an optional additive may be appropriately included depending on the intended use. For example, various additives such as a pigment, a dispersant, an antioxidant, an ultraviolet absorber, and a light stabilizer may be included. If these additives are included, the compounding amount thereof is preferably at least 0.1 parts by weight, and more preferably at least 0.5 parts by weight, and the upper limit is preferably not more than 10 parts by weight, and more preferably not more than 4 parts by weight per 100 parts by weight of the base resin.

For the intermediate layer material, it is suitable to abrade the surface of the intermediate layer in order to increase the degree of adhesion to a polyurethane preferably used in a cover material described later. Further, it is preferable that a primer (adhesive agent) is applied to the surface of the intermediate layer after the abrasion treatment, or an adhesion reinforcing agent is added to the intermediate layer material.

The material of the intermediate layer may contain an inorganic particulate filler. This inorganic particulate filler, although not particularly limited, is zinc oxide, barium sulfate, titanium dioxide, or the like may be appropriately used. Barium sulfate may be suitably used, and particularly preferably precipitated barium sulfate may be suitably used from the viewpoint of excellent durability to cracking on repeated impact.

A mean particle size of the inorganic particulate filler, although not particularly limited, may be preferably from 0.01 to 100 μm, and more preferably from 0.1 to 10 μm. If the mean particle size of the inorganic particulate filler is too small or too large, dispersibility during material preparation may be deteriorated. The mean particle size means a particle size measured by dispersing the particles in an aqueous solution together with an appropriate dispersant and measuring the particles with a particle size distribution measuring device.

The compounding amount of the inorganic particulate filler is not particularly limited, although the compounding amount is preferably set to at least 0 part by weight, more preferably at least 10 parts by weight, and even more preferably at least 15 parts, per 100 parts by weight of the base resin of the intermediate layer material. Although there is no particular upper limit, the compounding amount is preferably not more than 50 parts by weight, more preferably not more than 40 parts by weight, and even more preferably not more than 30 parts by weight. At an inorganic particulate filler compounding amount that is too low, the durability to cracking on repeated impact may worsen. On the other hand, at an inorganic particulate filler compounding amount that is too high, the ball rebound may decrease or the spin rate of the ball on full shots may rise, as a result of which the intended distance may not be achieved.

A specific gravity of the intermediate layer is preferably at least 1.05, more preferably at least 1.07, and even more preferably at least 1.09, and the upper limit is preferably not more than 1.25, more preferably not more than 1.20, and even more preferably not more than 1.15. If the specific gravity of the intermediate layer is too small, the durability to cracking on repeated impact may worsen. On the other hand, if the specific gravity of the intermediate layer is too large, the ball rebound becomes low, or the spin rate of the ball on full shots rises, and the intended distance may not be attained.

The initial velocity of the sphere (intermediate layer-encased sphere) in which the core is encased with the intermediate layer is preferably at least 77.0 m/s, more preferably at least 77.3 m/s, and even more preferably at least 77.5 m/s, and an upper limit thereof is preferably not more than 78.5 m/s, more preferably not more than 78.2 m/s, and even more preferably not more than 77.9 m/s. A ball initial velocity that is too high may fall outside the range specified in the Rules of Golf. On the other hand, when the initial velocity becomes too low, the ball rebound on full shots may become low, or the spin rate of the ball rises, and the intended distance may not be attainable. The initial velocity in this case is measured with the same device and under the same conditions as described above for the measurement of the initial velocity of the core described above.

Next, the cover is described.

The cover has a material hardness on the Shore C hardness scale that, although not particularly limited, is preferably at least 50, more preferably at least 55, and even more preferably at least 59, and an upper limit thereof is preferably not more than 80, more preferably not more than 74, and even more preferably not more than 70. A surface hardness on the Shore D hardness scale is preferably at least 30, more preferably at least 35, and even more preferably at least 38, and an upper limit thereof is preferably not more than 53, more preferably not more than 48, and even more preferably not more than 45.

The sphere (ball) obtained by encasing the intermediate layer-encased sphere with the cover has a surface hardness which, on the Shore C hardness scale, is preferably at least 73, more preferably at least 78, and even more preferably at least 81, and an upper limit thereof is preferably not more than 94, more preferably not more than 91, and even more preferably not more than 88. The surface hardness on the Shore D hardness scale is preferably at least 50, more preferably at least 53, and even more preferably at least 56, but is preferably not more than 70, more preferably not more than 65, and even more preferably not more than 60.

If the material hardness and the surface hardness of the cover are too soft in comparison with the above ranges, the spin rate of the ball on full shots may rise excessively, and the distance may not be increased. On the other hand, if the material hardness and the surface hardness of the cover are too hard in comparison with the above ranges, the ball may not be fully receptive to spin on approach shots, or a scuff resistance may worsen.

The cover has a thickness of preferably at least 0.3 mm, more preferably at least 0.45 mm, and even more preferably at least 0.6 mm. The upper limit in the cover thickness is preferably not more than 1.2 mm, more preferably not more than 0.9 mm, and even more preferably not more than 0.8 mm. If the cover is too thick, the ball rebound may be inadequate on full shots, or the spin rate of the ball may rise, and as a result, the distance may not be increased. On the other hand, when the cover is too thin, the scuff resistance may worsen or the ball may not be receptive to spin on approach shots and may lack sufficient controllability.

As a cover material, various types of thermoplastic resin used as a cover material in golf balls may be used, but it is suitable to use a resin material composed primarily of a thermoplastic polyurethane from the viewpoints of spin controllability in the short game and scuff resistance. That is, the cover is preferably formed of a resin blend containing (I) a thermoplastic polyurethane and (II) a polyisocyanate compound as principal components.

The total weight of the components (I) and (II) is recommended to be at least 60%, and more preferably at least 70% with respect to the total amount of the resin composition of the cover. The components (I) and (II) are described in detail below.

Describing the thermoplastic polyurethane (I), the construction of the thermoplastic polyurethane includes a soft segment composed of a polymeric polyol (polymeric glycol), which is a long-chain polyol, and a hard segment composed of a chain extender and a polyisocyanate compound. Here, as the long-chain polyol serving as a starting material, any of those hitherto used in the art related to thermoplastic polyurethane may be used, and are not particularly limited, and examples thereof may include polyester polyol, polyether polyol, polycarbonate polyol, polyester polycarbonate polyol, polyolefin polyol, conjugated diene polymer-based polyol, castor oil-based polyol, silicone-based polyol, and vinyl polymer-based polyol. These long-chain polyols may be used singly, or two or more may be used in combination. Among them, a polyether polyol is preferable from the viewpoint that a thermoplastic polyurethane having a high rebound resilience and excellent low-temperature properties can be synthesized.

As the chain extender, those hitherto used in the art related to thermoplastic polyurethanes may be suitably used, and for example, a low-molecular-weight compound having on the molecule two or more active hydrogen atoms capable of reacting with an isocyanate group and having a molecular weight of not more than 400 is preferable. Examples of the chain extender include, but are not limited to, 1,4-butylene glycol, 1,2-ethylene glycol, 1,3-butanediol, 1,6-hexanediol, 2,2-dimethyl-1,3-propanediol, or the like. Among them, the chain extender is preferably an aliphatic diol having from 2 to 12 carbon atoms, and is more preferably 1,4-butylene glycol.

As the polyisocyanate compound, those hitherto used in the art related to thermoplastic polyurethane may be suitably used, and are not particularly limited. Specifically, one or more selected from the group consisting of 4,4'-diphenylmethane diisocyanate, 2,4-toluene diisocyanate (or) 2,6-toluene diisocyanate, p-phenylene diisocyanate, xylylene diisocyanate, 1,5-naphthylene diisocyanate, tetramethylxylene diisocyanate, hydrogenated xylylene diisocyanate, dicyclohexylmethane diisocyanate, tetramethylene diisocyanate, hexamethylene diisocyanate, isophorone diisocyanate, norbornene diisocyanate, trimethylhexamethylene diisocyanate, and dimer acid diisocyanate may be used. However, it may be difficult to control a crosslinking reaction during injection molding depending on the type of isocyanate. In the present invention, 4,4'-diphenylmethane diisocyanate, which is an aromatic diisocyanate, is most preferable from the viewpoint of providing a balance between stability during production and the physical properties to be manifested.

As specific examples of the thermoplastic polyurethane serving as the component (I), commercially available products may be used such as Pandex T-8295, Pandex T-8290, and Pandex T-8260 (all manufactured by DIC Covestro Polymer, Ltd.).

Although not an essential component, a thermoplastic elastomer other than the thermoplastic polyurethane may be included as a separate component (III) with the components (I) and (II). By including the component (III) in the resin blend, a flowability of the resin blend may be further improved, and various physical properties required of the golf ball cover material may be increased, such as rebound and scuff resistance.

A compositional ratio of the components (I), (II), and (III), although not particularly limited, is that, in order to sufficiently and effectively exhibit the advantageous effects of the present invention, the compositional ratio (I):(II):(III) is preferably in the weight ratio range of from 100:2:50 to 100:50:0, and more preferably from 100:2:50 to 100:30:8.

Furthermore, various additives other than the components constituting the thermoplastic polyurethane may be included in the resin blend as necessary, and for example, a pigment, a dispersant, an antioxidant, a light stabilizer, an ultraviolet absorber, an internal mold lubricant, or the like may be appropriately included.

The cover has a specific gravity, although not particularly limited, is preferably at least 1.00, more preferably at least 1.03, and even more preferably at least 1.06. The upper limit is preferably not more than 1.20, more preferably not more than 1.17, and even more preferably not more than 1.14. When the cover specific gravity is lower than the above range, the ratio of low specific gravity materials such as ionomer blended into the cover made chiefly of urethane ends up becoming high, as a result of which the scuff resistance may worsen. On the other hand, when the cover specific gravity is too high, the amount of filler added is high and the rebound may become too low, as a result of which the intended distance may be unattainable.

The manufacture of a multi-piece solid golf ball in which the above-described core, intermediate layer, and cover (outermost layer) are formed as successive layers may be performed by a customary method such as a known injection molding process. For example, an intermediate layer material is injected around the core in an injection mold to obtain an intermediate layer-encased sphere, and finally, a cover material, which is the outermost layer, is injection molded to obtain a multi-piece golf ball. In addition, it is also possible to produce a golf ball by preparing two half-cups pre-molded into hemispherical shapes, enclosing the core and the intermediate layer-encased sphere within the two half cups, and molding the core and the intermediate layer-encased sphere under applied heat and pressure.

The golf ball has a deflection (mm) when compressed under a final load of 1,275 N (130 kgf) from an initial load of 98 N (10 kgf) that is preferably at least 2.80 mm, more preferably at least 2.90 mm, and even more preferably at least 3.00 mm. An upper limit of the deflection is preferably not more than 3.80 mm, more preferably not more than 3.60 mm, and even more preferably not more than 3.40 mm. If the deflection of the golf ball is too small, that is, if the golf ball is too hard, the spin rate may rise excessively and a good distance may not be achieved, or the feel at impact may become too hard. On the other hand, if the deflection is too large, that is, if the golf ball is too soft, the ball rebound may become too low and a good distance may not be achieved, the feel at impact may be too soft, or the durability to cracking on repeated impact may worsen.

The sphere (ball) obtained by encasing the intermediate layer-encased sphere with the cover has an initial velocity that is preferably at least 76.8 m/s, more preferably at least 77.0 m/s, and even more preferably at least 77.2 m/s, and an upper limit thereof is not more than 77.724 m/s. If the initial velocity value is too high, the initial velocity of the ball becomes too fast, which is against the rules. On the other hand, when the ball initial velocity is too low, the ball may not travel well on full shots. The initial velocity in this case is measured with the same device and under the same conditions as described above for measurement of the initial velocities of the core and the intermediate layer-encased sphere.

Relationships Between Surface Hardnesses of Each Sphere

Expressed on the Shore C hardness scale, a value obtained by subtracting the core surface hardness from the surface hardness of the intermediate layer-encased sphere is preferably larger than 0, more preferably at least 8, and even more preferably at least 10, and an upper limit thereof is preferably not more than 32, more preferably not more than 25, and even more preferably not more than 20. If there is a deviation from the above ranges, the spin rate of the ball on full shots rises, and the intended distance may not be attainable.

Expressed on the Shore C hardness scale, a value obtained by subtracting the core center hardness from the surface hardness of the intermediate layer-encased sphere is preferably at least 40, more preferably at least 41, and even more preferably at least 42, and an upper limit thereof is preferably not more than 53, more preferably not more than 50, and even more preferably not more than 47. When the above value is too small, the spin rate of the ball may rise on full shots, and the intended distance may not be attained. On the other hand, if the above value is too large, the durability to cracking on repeated impact worsens, or the actual initial velocity on shots becomes lower, and the intended distance may not be attainable.

Expressed on the Shore C hardness scale, a value obtained by subtracting the ball surface hardness from the surface hardness of the intermediate layer-encased sphere is preferably larger than 0, more preferably at least 4, and even more preferably at least 6, and an upper limit thereof is preferably not more than 25, more preferably not more than 17, and even more preferably not more than 14. When the above value is too small, controllability in the short game may worsen. On the other hand, if the above value is too large, the spin rate of the ball on full shots may rise, and the intended distance may not be attainable.

Initial Velocity Relationships of Each Sphere

A relationship between the initial velocity of the sphere (intermediate layer-encased sphere) in which the core is encased with the intermediate layer and the initial velocity of the sphere (ball) in which the intermediate layer-encased sphere is encased with the cover preferably satisfies the following condition:

(initial velocity of ball)<(initial velocity of intermediate layer-encased sphere).

A value obtained by subtracting the initial velocity of the ball from the initial velocity of the intermediate layer-encased sphere is more than 0 m/s, preferably at least 0.10 m/s, and more preferably at least 0.30 m/s, and an upper limit thereof is preferably not more than 1.00 m/s, more preferably not more than 0.70 m/s, and even more preferably not more than 0.50 m/s. If this value is too large, the spin rate of the ball rises on full shots, the actual initial velocity on shots becomes low, or the like, and the intended distance may not be attainable. On the other hand, when this value is too small due to the cover, the cover becomes hard and the ball is not receptive to spin in the short game, or the durability on repeated impact may be inferior. In addition, when this value is small due to the intermediate layer, the spin rate of the ball rises on full shots, and the intended distance may not be attainable.

A value obtained by subtracting the initial velocity of the core from the initial velocity of the intermediate layer-encased sphere is preferably at least 0.65 m/s, more preferably at least 0.72 m/s, and even more preferably at least 0.80 m/s, and an upper limit thereof is preferably not more than 0.98 m/s, more preferably not more than 0.95 m/s, and even more preferably not more than 0.92 m/s. When this value is too large, the durability to cracking on repeated impact may worsen. On the other hand, when this value is too small, the spin rate of the ball rises on full shots, and the intended distance may not be attainable.

Specific Gravity Relationship Between Intermediate Layer and Cover

It is recommended that a difference in the specific gravity of each layer between the specific gravity of the intermediate layer and the specific gravity of the cover is typically within ±0.15, preferably within ±0.10, and more preferably within ±0.05. That is, a value of (specific gravity of cover)−(specific gravity of intermediate layer material) is typically at least −0.15, preferably at least −0.10, and more preferably at least −0.05, and the upper limit is typically not more than 0.15, preferably not more than 0.10, and more preferably not more than 0.05. When the difference in specific gravity between these layers is too large, in a case where the intermediate layer material and/or the cover material cannot be molded on a completely concentric circle with these layers and with the layers located inside these layers and is eccentric, the ball when with a putter may greatly wobble to the left or right.

Specific Gravity Relationship Between Intermediate Layer and Core

It is recommended that a difference in the specific gravity of each layer between the specific gravity of the intermediate layer and the specific gravity of the core is typically within ±0.15, preferably within ±0.10, and more preferably within ±0.05. That is, a value of (specific gravity of intermediate layer)−(specific gravity of core) is typically at least −0.15, preferably at least −0.10, and more preferably at least −0.05, and an upper limit thereof is typically not more than 0.15, preferably not more than 0.10, and more preferably not more than 0.05. If the difference in specific gravity between these layers is too large, in a case where the intermediate layer material cannot be molded on a completely concentric circle with the core layer and is eccentric, the ball hit with a putter may greatly wobble to the left or right.

Core Diameter and Ball Diameter

A relationship between the core diameter and a ball diameter, that is, a value of (core diameter)/(ball diameter), is preferably at least 0.860, more preferably at least 0.870, and even more preferably at least 0.880. An upper limit thereof is preferably not more than 0.940, more preferably not more than 0.910, and even more preferably not more than 0.895. When this value is too small, the initial velocity of the ball becomes low, or the deflection of the entire ball becomes small and the ball becomes hard, the spin rate of the ball on full shots rises, and the intended distance may not be attainable. On the other hand, when the above value is too large, the spin rate of the ball on full shots rises, and the intended distance may not be attainable, or the durability to cracking on repeated impact may worsen.

Difference in Deflection Between Core and Ball

Letting each deflection (mm) when each sphere of the core and the ball is compressed under a final load of 1,275 N (130 kgf) from an initial load of 98 N (10 kgf) be B (mm) and C (mm), a value of C−B is preferably at least 1.00 mm, more preferably at least 1.20 mm, and even more preferably at least 1.30 mm, and an upper limit thereof is preferably not more than 1.80 mm, more preferably not more than 1.70 mm, and even more preferably not more than 1.60 mm. If this value is too small, the spin rate of the ball rises on full shots, and the intended distance may not be attainable. On the other hand, if the above value is too large, the actual initial velocity on shots becomes low, the intended distance may not be attainable on shots with a driver (W #1), and the durability to cracking on repeated impact may worsen.

Numerous dimples may be formed on the outside surface of the cover. The number of dimples arranged on the surface of the cover, although not particularly limited, is preferably at least 250, more preferably at least 300, and even more preferably at least 320, and the upper limit is preferably not more than 380, more preferably not more than 350, and even more preferably not more than 340. When the number of dimples is larger than the above range, a ball trajectory may become lower, and a distance traveled by the ball may decrease. On the other hand, when the number of dimples decreases, the ball trajectory may become higher, and the distance traveled by the ball may not increase.

As for the shape of the dimples, one type or a combination of two or more types such as a circular shape, various polygonal shapes, a dewdrop shape, and other oval shapes may be appropriately used. For example, when circular dimples are used, the diameter may be about 2.5 mm or more and 6.5 mm or less, and the depth may be at least 0.08 mm and not more than 0.30 mm.

A dimple coverage ratio of the dimples on the spherical surface of the golf ball, specifically, a ratio (SR value) of a sum of the individual dimple surface areas, each defined by a flat plane circumscribed by an edge of a dimple, to a ball spherical surface area and on the assumption that the ball has no dimples, is desirably at least 70% and not more than 90% from the viewpoint of sufficiently exhibiting aerodynamic properties. In addition, a value Vo obtained by dividing the spatial volume of the dimples below the flat plane circumscribed by the edge of each dimple by a volume of a cylinder whose base is the flat plane and whose height is a maximum depth of the dimple from the base is preferably at least 0.35 and not more than 0.80 from the viewpoint of optimizing the ball trajectory. Furthermore, a VR value of a sum of the volumes of the individual dimples, formed below the flat plane circumscribed by the edge of a dimple, to a ball spherical volume and on the assumption that the ball has no dimples is preferably at least 0.6% and not more than 1.0%. If there is a deviation from the ranges of each numerical value described above, the resulting trajectory may not enable a good distance to be attained, and the ball may fail to travel a sufficiently satisfactory distance.

The multi-piece solid golf ball of the invention can be made to conform to the Rules of Golf for play. The inventive ball may be formed to a diameter which is such that the ball does not pass through a ring having an inner diameter of 42.672 mm and to a weight which is preferably between 45.0 and 45.93 g.

EXAMPLES

Hereinafter, the present invention is specifically described with reference to Examples and Comparative Examples, although the present invention is not limited to the following Examples.

Examples 1 to 4 and Comparative Examples 1 to 8

Formation of Core

In Examples 1 and 2 and Comparative Examples 1 to 8, a rubber composition of each Example shown in Table 1 was prepared, and then vulcanization molding was performed under vulcanization conditions according to each Example shown in Table 1 to produce a solid core.

In Examples 3 and 4, cores are produced based on the formulations in Table 1 in the same manner as described above.

TABLE 1

| | | Example | | | | Comparative Example | | | | | | | |
|---|---|---|---|---|---|---|---|---|---|---|---|---|---|
| Core formulation (pbw) | | 1 | 2 | 3 | 4 | 1 | 2 | 3 | 4 | 5 | 6 | 7 | 8 |
| Polybutadiene | | 100 | 100 | 100 | 100 | 100 | 100 | 100 | 100 | 100 | 100 | 100 | 100 |
| Zinc acrylate | | 34.5 | 32.5 | 34.5 | 32.5 | 38.0 | 36.0 | 34.0 | 42.0 | 40.0 | 22.5 | 20.5 | 18.5 |
| Organic peroxide A | | 1.0 | 1.0 | 1.0 | 1.0 | 0.6 | 0.6 | 0.6 | 0.6 | 0.6 | 0.6 | 0.6 | 0.6 |
| Organic peroxide B | | | | | | | | | | | 0.6 | 0.6 | 0.6 |
| Water | | 1.00 | 1.00 | 1.00 | 1.00 | 0.80 | 0.80 | 0.80 | 1.20 | 1.20 | | | |
| Antioxidant A | | | | | | 0.1 | 0.1 | 0.1 | 0.1 | 0.1 | 0.1 | 0.1 | 0.1 |
| Antioxidant B | | 0.3 | 0.3 | 0.3 | 0.3 | | | | | | | | |
| Sulfur | | 0.01 | 0.01 | 0.01 | 0.01 | | | | | | | | |
| Zinc stearate | | 2.0 | 2.0 | 2.0 | 2.0 | | | | | | | | |
| Zinc oxide | | 12.4 | 13.3 | 12.4 | 13.3 | 17.4 | 18.2 | 19.0 | 8.9 | 9.8 | 16.6 | 17.5 | 18.3 |
| Zinc salt of pentachlorothiophenol | | 0.60 | 0.60 | 0.60 | 0.60 | 1.00 | 1.00 | 1.00 | 1.50 | 1.50 | 0.15 | 0.15 | 0.15 |
| Sulfur (pbw)/water (weight ratio) | | 0.01 | 0.01 | 0.01 | 0.01 | 0 | 0 | 0 | 0 | 0 | — | — | — |
| Vulcanization conditions | Temperature (° C.) | 158 | 158 | 158 | 158 | 158 | 158 | 158 | 158 | 158 | 158 | 158 | 158 |
| | Time (min) | 18 | 18 | 18 | 18 | 18 | 18 | 18 | 20 | 20 | 16 | 16 | 16 |

Details of the above formulations are as follows.

Polybutadiene: Trade name "BR730" (manufactured by JSR Corporation)

Zinc acrylate: Trade name "ZN-DA85S" (manufactured by Nippon Shokubai Co., Ltd.)

Organic peroxide A: Dicumyl peroxide, trade name "Percumyl D" (manufactured by NOF Corporation)

Organic peroxide B: A mixture of 1,1-di(t-butylperoxy) cyclohexane and silica, trade name "Perhexa C-40" (manufactured by NOF Corporation)

Sulfur: Containing sulfur powder for rubber in an amount of 80 wt %, trade name "SANMIX S-80 N" (manufactured by Sanshin Chemical Industry Co., Ltd.)

Water: Pure water (manufactured by Seiki Co., Ltd.)

Antioxidant A: 2,2-methylenebis(4-methyl-6-butylphenol), trade name "Nocrac NS-6" (manufactured by Ouchi Shinko Chemical Industrial Co., Ltd.)

Antioxidant B: 2-mercaptobenzimidazole, trade name "Nocrac MB" (manufactured by Ouchi Shinko Chemical Industrial Co., Ltd.)

Zinc stearate: Trade name "Zinc stearate GP" (manufactured by NOF Corporation)

Zinc oxide: Trade name "Grade 3 Zinc Oxide" (manufactured by Sakai Chemical Industry Co., Ltd.)

Zinc salt of pentachlorothiophenol: Manufactured by Wako Pure Chemical Industries, Ltd.

Formation of Intermediate Layer and Cover (Outermost Layer)

Next, in Examples 1 and 2 and Comparative Examples 1 to 8, the intermediate layer was formed by injection molding the resin materials No. 1 to No. 3 of the intermediate layer shown in Table 2 around the core surface using an injection mold. Subsequently, the cover was formed by injection molding the resin material No. 4 of the cover (outermost layer) shown in Table 2 around the intermediate layer-encased sphere using a separate injection mold. At this time, a predetermined large number of dimples common to all Examples and Comparative Examples were formed on the surface of the cover.

In Examples 3 and 4, the intermediate layer is formed around the core surface by injection molding using the injection mold and the resin material No. 2 of the intermediate layer shown in Table 2. Subsequently, the cover is formed by injection molding the resin material No. 4 of the cover (outermost layer) shown in Table 2 around the intermediate layer-encased sphere using a separate injection mold. At this time, a predetermined large number of dimples common to all Examples and Comparative Examples are formed on the surface of the cover.

TABLE 2

| Resin composition (pbw) | Acid content (wt %) | Metal type | No. 1 | No. 2 | No. 3 | No. 4 |
|---|---|---|---|---|---|---|
| Himilan 1605 | 15 | Na | 50 | | 50 | |
| Himilan 1557 | 12 | Zn | 15 | 15 | 15 | |
| Himilan 1706 | 15 | Zn | 35 | | 35 | |
| AM7318 | 18 | Na | | 85 | | |
| Titanium oxide | | | | | | 3 |
| Barium sulfate | | | 20 | 20 | | |
| Trimethylolpropane | | | 1.1 | 1.1 | 1.1 | |
| TPU | | | | | | 100 |

Details of the blending components in the above table are as follows.

Trade names of the chief materials mentioned in the table are as follows.

"Himilan 1605", "Himilan 1557", "Himilan 1706", and "AM7318" ionomer resins manufactured by Dow-Mitsui Polychemicals Co., Ltd.

"Precipitated Barium Sulfate 300" barium sulfate manufactured by Sakai Chemical Industry Co., Ltd.

"Trimethylolpropane" (TMP) manufactured by Tokyo Chemical Industry Co., Ltd.

"Pandex" ether-type thermoplastic polyurethane (TPU), material hardness (Shore D) 42, manufactured by DIC Covestro Polymer Ltd.

For each resulting golf ball, various physical properties such as internal hardnesses at various positions of the core, outer diameters of the core and each layer-encased sphere, thicknesses and material hardnesses of each layer, surface hardnesses of each layer-encased sphere, and initial velocities of each layer-encased sphere are evaluated by the following methods, and are shown in Tables 3 and 4.

Core Hardness Profile

The core surface is spherical, but an indenter of a durometer is set substantially perpendicular to the spherical core surface, and a core surface hardness expressed on the Shore C hardness scale is measured in accordance with ASTM D2240. With respect to the core center and a predetermined position of the core, the core is cut into hemispheres to obtain a flat cross-section, the hardness is measured by perpendicularly pressing the indenter of the durometer against the center portion and the predetermined positions shown in Table 3, and the hardnesses at the center and each position are shown as Shore C hardness values. For the measurement of the hardnesses, a P2 Automatic Rubber Hardness Tester manufactured by Kobunshi Keiki Co., Ltd. equipped with a Shore C durometer is used. For the hardness value, a maximum value is read. All measurements are performed in an environment of 23±2° C. The numerical values in the table are Shore C hardness values.

In addition, in the core hardness profile, letting the Shore C hardness at the core center be Cc, the Shore C hardness at the midpoint M between the core center and the core surface be $C_m$, the respective Shore C hardnesses at positions 2 mm, 4 mm, and 6 mm inward from the midpoint M be Cm−2, Cm−4, and Cm−6, the respective Shore C hardnesses at positions 2 mm, 4 mm, and 6 mm outward from the midpoint M be Cm+2, Cm+4, and Cm+6, and the Shore C hardness at the core surface be Cs, the surface areas A to F are calculated as follows:

surface area A: ½×2×(Cm−4−Cm−6)
surface area B: ½×2×(Cm−2−Cm−4)
surface area C: ½×2×(Cm−Cm−2)
surface area D: ½×2×(Cm+2−Cm)
surface area E: ½×2×(Cm+4−Cm+2)
surface area F: ½×2×(Cm+6−Cm+4)

and the values of the following six expressions are determined.

(1) surface areas: A+B
(2) surface areas: B+C
(3) surface areas: D+E
(4) surface areas: E+F
(5) (surface areas: E+F)−(surface areas: A+B)
(6) (surface areas: D+E)−(surface areas: B+C)

The surface areas A to F in the core hardness profile are described in FIG. 2, which shows a graph that illustrates surface areas A to F using the core hardness profile data from Examples 1 and 3.

Figure 3:
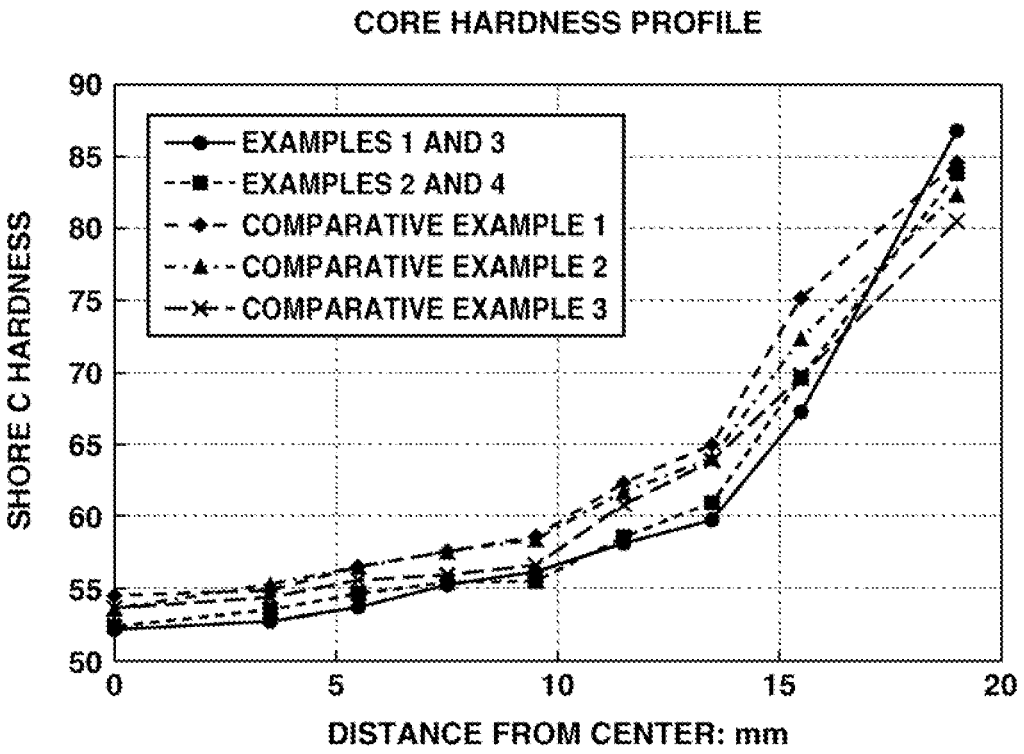
FIG. 3 is a graph showing the core hardness profiles in Examples 1 to 4 and Comparative Examples 1 to 3.
Figure 4:
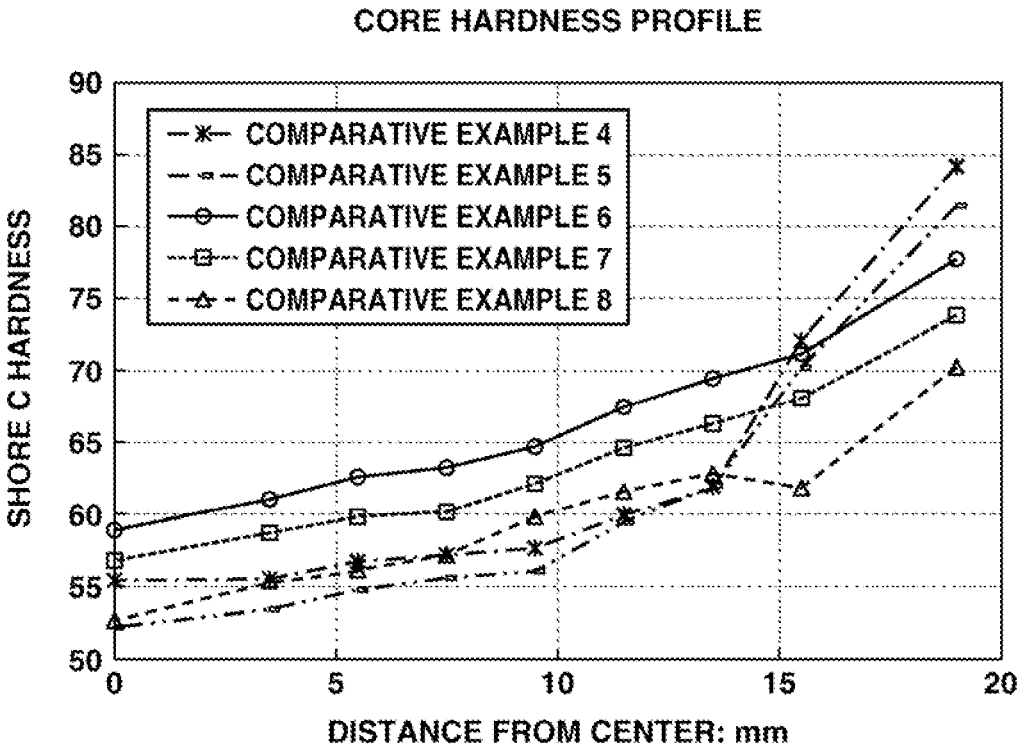
FIG. 4 is a graph showing the core hardness profiles in Comparative Examples 4 to 8.

In addition, FIGS. 3 and 4 show graphs of core hardness profiles for Examples 1 to 4 and Comparative Examples 1 to 8.

Diameters of Core and of Intermediate Layer-Encased Sphere

At a temperature adjusted to 23.9±1° C. for at least three hours or more in a thermostatic bath, five random places on the surface are measured in a room with a temperature of 23.9±2° C., and, using an average value of these measurements as a measured value of each sphere, an average value for the diameter of 10 such spheres is determined.

Ball Diameter

At a temperature adjusted to 23.9±1° C. for at least three hours or more in a thermostatic bath, a diameter at 15 random dimple-free places is measured in a room at a temperature of 23.9±2° C., and, using an average value of these measurements as a measured value of one ball, an average value for the diameter of 10 balls is determined.

Deflections of Core, Intermediate Layer-Encased Sphere, and Ball

Each subject layer-encased sphere is placed on a hard plate, and a deflection when compressed under a final load of 1,275 N (130 kgf) from an initial load of 98 N (10 kgf) is measured. Note that the deflection in each case is a measurement value measured in a room at a temperature of 23.9±2° C. after temperature adjustment to 23.9±1° C. for at least three hours or more in a thermostatic bath. A pressing speed of the core, the layer-encased sphere of each layer, or a head that compresses the ball is set to 10 mm/s.

In addition, FIG. 5 shows a graph showing a relationship between the deflection of the core and the difference in hardness between the core surface hardness and the core center hardness for each Example and Comparative Example.

Material Hardnesses of Intermediate Layer and Cover (Shore C and Shore D Hardnesses)

The resin material of each layer is molded into a sheet having a thickness of 2 mm and left at a temperature of 23±2° C. for two weeks. At the time of measurement, three such sheets are stacked together. The Shore C hardness and the Shore D hardness are each measured with a Shore C durometer and a Shore D durometer conforming to the ASTM D2240 standard. For the measurement of the hardness, the P2 Automatic Rubber Hardness Tester manufactured by Kobunshi Keiki Co., Ltd. to which a Shore C durometer or a Shore D durometer is mounted is used. For the hardness value, a maximum value is read. The measurement method is in accordance with the ASTM D2240 standard.

Surface Hardnesses of Intermediate Layer-Encased Sphere and of Ball

A measurement is performed by perpendicularly pressing the indenter against the surface of each sphere. The surface hardness of the ball (cover) is a measured value at a dimple-free area (land) on the surface of the ball. The Shore C hardness and the Shore D hardness are each measured with a Shore C durometer and a Shore D durometer conforming to the ASTM D2240 standard. For the measurement of the hardness, the P2 Automatic Rubber Hardness Tester manufactured by Kobunshi Keiki Co., Ltd. to which a Shore C durometer or a Shore D durometer is mounted is used. For the hardness value, a maximum value is read. The measurement method is in accordance with the ASTM D2240 standard.

Initial Velocity of Each Sphere

The initial velocity of each sphere is measured at a temperature of 23.9±2° C. using the device for measuring COR manufactured by Hye Precision Products of the same type as the R&A. The measurement principle is as follows.

An air pressure is changed to four stages of 35.5 psi, 36.5 psi, 39.5 psi, and 40.5 psi, and a ball is fired at four stages of incident velocity by respective air pressures, collided with a barrier, and its COR is measured. That is, a correlation equation between the incident velocity and the COR is created by changing the air pressure in four stages. Similarly, a correlation equation between the incident velocity and a contact time is created.

Then, from these correlation equations, the COR (coefficient of restitution) and the contact time (μs) at an incident velocity of 43.83 m/s are determined and substituted into the following initial velocity conversion equation to calculate an initial velocity of each sphere.

$$IV=136.8+136.3e+0.019tc$$

[Here, e is a coefficient of restitution, and tc is a contact time (μs) at a collision speed of 143.8 ft/s (43.83 m/s).]

In the initial velocity measurement of each sphere, the barrel diameter is selected so that the clearance on one side between the barrel diameter and the diameter of the object for measurement is from 0.2 to 2.0 mm, and the barrel diameter used in the present Example and the Comparative Examples is 39.88 mm for the core, 41.53 mm for the intermediate layer-encased sphere, and 43.18 mm for the balls of all examples.

TABLE 3

| | | Example | | | | Comparative Example | | | | | | | |
|---|---|---|---|---|---|---|---|---|---|---|---|---|---|
| | | 1 | 2 | 3 | 4 | 1 | 2 | 3 | 4 | 5 | 6 | 7 | 8 |
| | Construction (piece) | 3P | 3P | 3P | 3P | 3P | 3P | 3P | 3P | 3P | 3P | 3P | 3P |
| Core | Outer diameter (mm) | 38.08 | 38.03 | 38.08 | 38.03 | 38.05 | 38.03 | 38.04 | 38.05 | 38.04 | 38.03 | 38.04 | 38.00 |
| | Weight (g) | 32.85 | 32.75 | 32.85 | 32.75 | 33.84 | 33.81 | 33.83 | 32.72 | 32.71 | 32.51 | 32.59 | 32.52 |
| | Specific gravity | 1.14 | 1.14 | 1.14 | 1.14 | 1.17 | 1.17 | 1.17 | 1.13 | 1.13 | 1.13 | 1.13 | 1.13 |
| | Deflection (mm) | 4.42 | 4.78 | 4.42 | 4.78 | 4.06 | 4.35 | 4.57 | 4.31 | 4.46 | 4.03 | 4.44 | 4.95 |
| | Initial velocity (m/s) | 76.79 | 76.8 | 76.79 | 76.8 | 76.63 | 76.54 | 76.59 | 76.57 | 76.4 | 76.89 | 76.71 | 76.65 |
| | Cs (Shore C) | 86.8 | 83.8 | 86.8 | 83.8 | 84.6 | 82.3 | 80.4 | 84.3 | 81.5 | 77.8 | 78.9 | 70.2 |
| | Cm + 6 (Shore C) | 67.2 | 69.6 | 67.2 | 69.6 | 75.1 | 72.4 | 69.8 | 72.1 | 70.2 | 71.1 | 68.1 | 61.7 |
| | Cm + 4 (Shore C) | 59.7 | 60.9 | 59.7 | 60.9 | 64.9 | 64.0 | 63.8 | 61.8 | 62.0 | 69.4 | 66.3 | 62.7 |
| | Cm + 2 (Shore C) | 58.1 | 58.6 | 58.1 | 58.6 | 62.3 | 61.6 | 60.8 | 60.0 | 59.4 | 67.4 | 64.6 | 61.6 |
| | Cm (Shore C) | 56.1 | 55.6 | 56.1 | 55.6 | 58.6 | 68.4 | 56.6 | 57.6 | 56.0 | 64.6 | 62.1 | 59.7 |
| | Cm − 2 (Shore C) | 55.3 | 55.4 | 55.3 | 55.4 | 57.5 | 57.5 | 55.9 | 57.1 | 55.5 | 63.2 | 60.1 | 57.1 |
| | Cm − 4 (Shore C) | 53.7 | 54.6 | 53.7 | 54.6 | 56.4 | 56.5 | 55.6 | 56.6 | 54.7 | 62.6 | 59.8 | 56.0 |
| | Cm − 6 (Shore C) | 52.8 | 53.5 | 52.8 | 53.5 | 54.8 | 55.2 | 54.4 | 55.4 | 53.3 | 61.0 | 58.6 | 55.2 |
| | Cc (Shore C) | 52.2 | 52.4 | 52.2 | 52.4 | 54.5 | 53.5 | 53.6 | 55.3 | 52.1 | 58.9 | 56.7 | 52.6 |
| | Cs − Cc (Shore C) | 34.6 | 31.4 | 34.6 | 31.4 | 30.1 | 28.8 | 26.8 | 29.0 | 29.4 | 18.9 | 22.2 | 17.6 |
| | C × (Cs − Cc) | 152.9 | 150.1 | 152.9 | 150.1 | 122.2 | 125.3 | 122.5 | 125.0 | 131.1 | 76.2 | 98.6 | 87.1 |
| | (Cs − Cc)/(Cm − Cc) | 8.9 | 9.8 | 8.9 | 9.8 | 7.3 | 1.9 | 8.9 | 12.6 | 7.5 | 3.3 | 4.1 | 2.5 |
| | Surface area A | 0.9 | 1.1 | 0.9 | 1.1 | 1.6 | 1.3 | 1.2 | 1.2 | 1.4 | 1.6 | 1.2 | 0.8 |
| | Surface area B | 1.6 | 0.8 | 1.6 | 0.8 | 1.1 | 1.0 | 0.3 | 0.5 | 0.8 | 0.6 | 0.3 | 1.1 |
| | Surface area C | 0.8 | 0.2 | 0.8 | 0.2 | 1.1 | 10.9 | 0.7 | 0.5 | 0.5 | 1.4 | 2.0 | 2.6 |
| | Surface area D | 2.0 | 3.0 | 2.0 | 3.0 | 3.7 | −6.8 | 4.2 | 2.4 | 3.4 | 2.8 | 2.5 | 1.9 |
| | Surface area E | 1.6 | 2.3 | 1.6 | 2.3 | 2.6 | 2.4 | 3.0 | 1.8 | 2.6 | 2.0 | 1.7 | 1.1 |
| | Surface area F | 7.5 | 8.7 | 7.5 | 8.7 | 10.2 | 8.4 | 6.0 | 10.3 | 8.2 | 1.7 | 1.8 | −1.0 |
| | Surface area E + surface area F | 9.1 | 11.0 | 9.1 | 11.0 | 12.8 | 10.8 | 9.0 | 12.1 | 10.8 | 3.7 | 3.5 | 0.1 |
| | Surface area D + surface area E | 3.6 | 5.3 | 3.6 | 5.3 | 6.3 | −4.4 | 7.2 | 4.2 | 6.0 | 4.8 | 4.2 | 3.0 |
| | Surface area B + surface area C | 2.4 | 1.0 | 2.4 | 1.0 | 2.2 | 11.9 | 1.0 | 1.0 | 1.3 | 2.0 | 2.3 | 3.7 |
| | Surface area A + surface area B | 2.5 | 1.9 | 2.5 | 1.9 | 2.7 | 2.3 | 1.5 | 1.7 | 2.2 | 2.2 | 1.5 | 1.9 |
| | (Surface areas: E + F) − (surface areas: A + B) | 6.6 | 9.1 | 6.6 | 9.1 | 10.1 | 8.5 | 7.5 | 10.4 | 8.6 | 1.5 | 2.0 | −1.8 |
| | (Surface areas: D + E) − (surface areas: B + C) | 1.2 | 4.3 | 1.2 | 4.3 | 4.1 | −16.3 | 6.2 | 3.2 | 4.7 | 2.8 | 1.9 | −0.7 |

TABLE 4

| | | Example | | | | Comparative Example | | | | | | | |
|---|---|---|---|---|---|---|---|---|---|---|---|---|---|
| | | 1 | 2 | 3 | 4 | 1 | 2 | 3 | 4 | 5 | 6 | 7 | 8 |
| Intermediate layer | Material | No. 1 | No. 1 | No. 2 | No. 2 | No. 3 | No. 3 | No. 3 | No. 1 | No. 1 | No. 2 | No. 2 | No. 2 |
| | Thickness (mm) | 1.48 | 1.51 | 1.48 | 1.51 | 1.51 | 1.52 | 1.51 | 1.50 | 1.51 | 1.52 | 1.51 | 1.52 |
| | Specific gravity | 1.09 | 1.09 | 1.09 | 1.09 | 0.96 | 0.96 | 0.96 | 1.09 | 1.09 | 1.09 | 1.09 | 1.09 |
| | Material hardness (Shore C) | 95 | 95 | 94 | 94 | 95 | 95 | 95 | 95 | 95 | 94 | 94 | 94 |
| | Material hardness (Shore D) | 69 | 69 | 68 | 68 | 67 | 67 | 67 | 69 | 69 | 68 | 68 | 68 |
| Intermediate layer-encased sphere | Outer diameter (mm) | 41.04 | 41.05 | 41.04 | 41.05 | 41.06 | 41.07 | 41.06 | 41.05 | 41.05 | 41.06 | 41.05 | 41.03 |
| | Weight (g) | 40.73 | 40.74 | 40.73 | 40.74 | 40.79 | 40.80 | 40.79 | 40.67 | 40.68 | 40.52 | 40.55 | 40.57 |
| | Deflection (mm) | 3.34 | 3.65 | 3.28 | 3.59 | 3.28 | 3.43 | 3.59 | 3.29 | 3.44 | 3.22 | 3.49 | 3.84 |
| | Initial velocity (m/s) | 77.70 | 77.68 | 77.68 | 77.64 | 77.62 | 77.67 | 77.73 | 77.40 | 77.42 | 77.54 | 77.44 | 77.19 |
| | Surface hardness (Shore C) | 98.1 | 97.9 | 98.0 | 98.0 | 97.7 | 97.7 | 97.6 | 97.6 | 97.5 | 97.8 | 97.3 | 97.5 |
| | Surface hardness (Shore D) | 71.2 | 71.4 | 71.2 | 70.5 | 70.1 | 70.5 | 70.7 | 71.6 | 70.8 | 71.6 | 71.0 | 71.3 |
| Intermediate layer surface hardness − core surface hardness (Shore C) | | 11.3 | 14.1 | 11.2 | 14.2 | 13.1 | 15.4 | 17.2 | 13.3 | 16.0 | 20.0 | 18.4 | 27.3 |
| Intermediate layer surface hardness − core center hardness (Shore C) | | 45.9 | 45.5 | 45.8 | 45.6 | 43.2 | 44.2 | 44.0 | 42.3 | 45.4 | 38.9 | 40.6 | 44.9 |
| Cover | Material | No. 4 | No. 4 | No. 4 | No. 4 | No. 4 | No. 4 | No. 4 | No. 4 | No. 4 | No. 4 | No. 4 | No. 4 |
| | Thickness (mm) | 0.83 | 0.83 | 0.83 | 0.83 | 0.82 | 0.82 | 0.82 | 0.83 | 0.83 | 0.83 | 0.83 | 0.84 |
| | Specific gravity | 1.12 | 1.12 | 1.12 | 1.12 | 1.12 | 1.12 | 1.12 | 1.12 | 1.12 | 1.12 | 1.12 | 1.12 |
| | Material hardness (Shore C) | 60 | 60 | 60 | 60 | 60 | 60 | 60 | 60 | 60 | 60 | 60 | 60 |
| | Material hardness (Shore D) | 42 | 42 | 42 | 42 | 42 | 42 | 42 | 42 | 42 | 42 | 42 | 42 |
| Ball | Outer diameter (mm) | 42.70 | 42.70 | 42.70 | 42.70 | 42.71 | 42.71 | 42.70 | 42.71 | 42.70 | 42.72 | 42.71 | 42.70 |
| | Weight (g) | 45.6 | 45.6 | 45.6 | 45.5 | 45.6 | 45.6 | 45.6 | 45.5 | 45.5 | 45.4 | 45.4 | 45.4 |
| | Deflection (mm) | 3.06 | 3.26 | 2.99 | 3.18 | 3.03 | 3.15 | 3.33 | 3.06 | 3.22 | 2.97 | 3.22 | 3.55 |
| | Initial velocity (m/s) | 77.35 | 77.29 | 77.37 | 77.31 | 77.33 | 77.32 | 77.35 | 77.06 | 77.05 | 77.21 | 77.11 | 76.94 |
| | Surface hardness (Shore C) | 84.4 | 84.3 | 84.0 | 84.6 | 85.2 | 85.0 | 84.7 | 84.8 | 84.3 | 84.6 | 84.5 | 84.1 |
| | Surface hardness (Shore D) | 58.0 | 57.0 | 57.1 | 57.5 | 57.7 | 58.0 | 57.3 | 57.7 | 56.7 | 57.7 | 57.4 | 57.4 |
| Intermediate layer surface hardness − ball surface hardness (Shore C) | | 13.7 | 13.6 | 14.0 | 13.4 | 12.5 | 12.7 | 12.9 | 12.8 | 13.2 | 13.2 | 12.8 | 13.4 |
| Core deflection − ball deflection (mm) | | 1.36 | 1.52 | 1.43 | 1.60 | 1.03 | 1.20 | 1.24 | 1.25 | 1.24 | 1.06 | 1.22 | 1.40 |
| Core diameter/ball diameter | | 0.892 | 0.891 | 0.892 | 0.891 | 0.891 | 0.890 | 0.891 | 0.891 | 0.891 | 0.890 | 0.891 | 0.890 |
| Intermediate layer thickness − cover thickness (mm) | | 0.65 | 0.68 | 0.65 | 0.68 | 0.68 | 0.70 | 0.69 | 0.67 | 0.68 | 0.69 | 0.67 | 0.68 |
| Difference in specific gravity between each element | Specific gravity of cover material − specific gravity of intermediate layer | 0.03 | 0.03 | 0.03 | 0.03 | 0.16 | 0.16 | 0.16 | 0.03 | 0.03 | 0.03 | 0.03 | 0.03 |
| | specific gravity of intermediate layer − specific gravity of core | −0.05 | −0.05 | −0.05 | −0.05 | −0.21 | −0.21 | −0.21 | −0.04 | −0.04 | −0.04 | −0.04 | −0.04 |
| Difference in initial velocity | Intermediate layer-encased sphere − ball (m/s) | 0.35 | 0.39 | 0.31 | 0.33 | 0.29 | 0.35 | 0.38 | 0.34 | 0.37 | 0.33 | 0.33 | 0.25 |
| | Intermediate layer-encased sphere − core (m/s) | 0.91 | 0.88 | 0.89 | 0.84 | 0.99 | 1.13 | 1.14 | 0.83 | 1.02 | 0.65 | 0.73 | 0.54 |

The flight (driver) (utility) (I #6) (I #8), the controllability on approach shots, and the durability on repeated impact of each golf ball are evaluated by the following methods. The results are shown in Table 5.

Evaluation of Flight (W #1, HS 40 m/s)

A driver is mounted on a golf swing robot, and a spin rate and a distance traveled (total) by a ball when struck at a head speed (HS) of 40 m/s are measured. The club used is a JGR driver/loft angle 9.5° (2016 model) manufactured by Bridgestone Sports Co., Ltd. and is evaluated according to the following criteria.

[Rating Criteria]

Good: Total distance is at least 209.0 m

NG: Total distance is less than 209.0 m

Evaluation of Flight (W #1, HS 35 m/s)

The driver is mounted on the golf swing robot, and the spin rate and the distance traveled (total) by the ball when struck at a head speed (HS) of 35 m/s are measured. The club used is a JGR driver/loft angle 9.5° (2016 model) manufactured by Bridgestone Sports Co., Ltd. and is evaluated according to the following criteria.

[Rating Criteria]

Good: Total distance is at least 178.5 m

NG: Total distance is less than 178.5 m

Evaluation of Flight (Utility)

A utility club is mounted on the golf swing robot, and the spin rate and the distance traveled (total) by the ball when struck at a head speed (HS) of 38 m/s are measured. The club used is a JGR H2 (2016 model) manufactured by Bridgestone Sports Co., Ltd. The rating criteria are as follows.

[Rating Criteria]

Good: Total distance is at least 160.0 m

NG: Total distance is less than 160.0 m

Evaluation of Flight (I #6, HS 40 m/s)

When a number six iron (I #6) is mounted on the golf swing robot and the ball is struck at an HS of 40 m/s, the spin rate and the distance traveled (total) are measured and rated according to the following criteria. The club used is a JGR Forged I #6 (2016 model) manufactured by Bridgestone Sports Co., Ltd.

[Rating Criteria]

Good: Total distance is 168.0 m or more

NG: Total distance is less than 168.0 m

Evaluation of Flight (I #6, HS 35 m/s)

When the number six iron (I #6) is mounted on the golf swing robot and the ball is struck at an HS of 35 m/s, the spin rate and the distance traveled (total) are measured and rated according to the following criteria. The club used is a JGR Forged I #6 (2016 model) manufactured by Bridgestone Sports Co., Ltd.

[Rating Criteria]

Good: Total distance is at least 146.0 m

NG: Total distance is less than 146.0 m

Evaluation of Flight (I #8)

When a number eight iron (I #8) is mounted on the golf swing robot and the ball is struck at an HS of 35 m/s, the spin rate and the distance traveled (total) are measured and rated according to the following criteria. The club used is a JGR Forged I #8 (2016 model) manufactured by Bridgestone Sports Co., Ltd.

[Rating Criteria]

Good: Total distance is at least 131.0 m

NG: Total distance is less than 131.0 m

Evaluation of Spin Rate on Approach Shots

A judgment is made based on a spin rate when a sand wedge is mounted on the golf swing robot and the ball is struck at a head speed HS of 15 m/s. Similarly, a spin rate immediately after the ball is struck is measured by a device for measuring initial conditions. The sand wedge used is a TOURSTAGE TW-03 (loft angle 57°) 2002 model manufactured by Bridgestone Sports Co., Ltd.

[Rating Criteria]

Good: Spin rate is at least 4,400 rpm

NG: Spin rate is less than 4,400 rpm

Durability to Cracking on Repeated Impact

A durability of the golf ball is evaluated using an ADC Ball COR Durability Tester produced by Automated Design Corporation (U.S.). The tester fires a golf ball pneumatically and causes it to repeatedly strike two metal plates installed in parallel, and the durability of the ball is an average value of the number of times of firing required until the ball cracks. In this case, the average value is a value obtained by preparing 10 balls of the same type and, by firing each ball, averaging the number of times of firing required until each of the 10 balls cracks. The tester is a horizontal COR type, and an incident velocity against the metal plates is set to 43 m/s.

[Rating Criteria]

Good: Average value is at least 160 times

NG: Average value is not more than 159 times

TABLE 5

| | | | Example | | | | Comparative Example | | | | | | | |
|---|---|---|---|---|---|---|---|---|---|---|---|---|---|---|
| | | | 1 | 2 | 3 | 4 | 1 | 2 | 3 | 4 | 5 | 6 | 7 | 8 |
| Flight | W#1 HS 40 m/s | Spin rate (rpm) | 2,957 | 2,882 | 2,989 | 2,935 | 2,985 | 2,931 | 2,829 | 2,967 | 2,964 | 3,133 | 2,943 | 2,877 |
| | | Total (m) | 211.6 | 209.9 | 212.1 | 210.3 | 209.5 | 206.7 | 210.5 | 209.4 | 207.9 | 208.4 | 210.9 | 207.1 |
| | | Rating | Good | Good | Good | Good | Good | NG | Good | Good | NG | NG | Good | NG |
| | W#1 HS 35 m/s | Spin rate (rpm) | 2,883 | 2,830 | 2,924 | 2,810 | 2,894 | 2,865 | 2,815 | 2,859 | 2,882 | 2,978 | 2,826 | 2,754 |
| | | Total (m) | 181.4 | 178.8 | 182.0 | 181.2 | 177.4 | 180.6 | 180.2 | 180.1 | 180.3 | 175.5 | 178.2 | 178.6 |
| | | Rating | Good | Good | Good | Good | NG | Good | Good | Good | Good | NG | NG | Good |
| | Utility HS 38 m/s | Spin rate (rpm) | 4,877 | 4,734 | 4,879 | 4,752 | 4,978 | 4,821 | 4,675 | 4,876 | 4,790 | 5,042 | 4,762 | 4,570 |
| | | Total (m) | 160.9 | 162.6 | 160.9 | 163.6 | 160.8 | 162.0 | 161.1 | 158.8 | 159.9 | 157.6 | 160.9 | 162.1 |
| | | Rating | Good | Good | Good | Good | Good | Good | Good | NG | NG | NG | Good | Good |
| | I#6 HS 40 m/s | Spin rate (rpm) | 5,064 | 4,834 | 5,035 | 4,776 | 5,224 | 5,003 | 4,858 | 5,074 | 4,985 | 5,458 | 5,133 | 4,896 |
| | | Total (m) | 168.4 | 168.2 | 168.6 | 169.7 | 167.2 | 170.1 | 168.9 | 166.6 | 167.4 | 166.4 | 167.1 | 166.9 |
| | | Rating | Good | Good | Good | Good | NG | Good | Good | NG | NG | NG | NG | NG |
| | I#6 HS 35 m/s | Spin rate (rpm) | 4,733 | 4,514 | 4,744 | 4,420 | 4,841 | 4,731 | 4,582 | 4,770 | 4,674 | 5,136 | 4,828 | 4,566 |
| | | Total (m) | 147.8 | 146.8 | 149.6 | 146.4 | 147.4 | 147.1 | 147.7 | 147.9 | 146.9 | 145.9 | 147.9 | 147.1 |
| | | Rating | Good | Good | Good | Good | Good | Good | Good | Good | Good | NG | Good | Good |
| | I#8 HS 35 m/s | Spin rate (rpm) | 6,159 | 5,923 | 6,180 | 5,961 | 6,290 | 6,126 | 5,889 | 6,166 | 6,058 | 6,530 | 6,167 | 5,928 |
| | | Total (m) | 132.4 | 131.3 | 132.3 | 131.6 | 129.9 | 131.4 | 132.4 | 130.4 | 130.8 | 129.4 | 131.0 | 131.7 |
| | | Rating | Good | Good | Good | Good | NG | Good | Good | NG | NG | NG | Good | Good |
| Approach shots | SW HS 15 m/s | Spin rate (rpm) | 4,816 | 4,715 | 4,803 | 4,714 | 4,900 | 4,746 | 4,679 | 4,794 | 4,707 | 4,874 | 4,658 | 4,478 |
| | | Rating | Good | Good | Good | Good | Good | Good | Good | Good | Good | Good | Good | Good |
| Durability to cracking on repeated impact | | Number of cracks | 205 | 174 | 216 | 172 | 150 | 145 | 155 | 200 | 180 | 271 | 217 | 192 |
| | | Rating | Good | Good | Good | Good | NG | NG | NG | Good | Good | Good | Good | Good |

As shown in the results in Table 5, the golf balls of Comparative Examples 1 to 8 are inferior in the following respects to the golf balls according to the present invention (Examples).

In Comparative Example 1, the value of the multiplication formula C×(Cs−Cc) of "the deflection of the core at the time of applying a predetermined load" and "the difference in hardness between the core surface hardness and the core center hardness" is smaller than 132.0, and the specific gravity of the intermediate layer material is smaller than 1.05. As a result, on shots with the driver (W #1, HS 35 m/s), the number six iron (I #6, HS 40 m/s), and the number eight iron (I #8), the distance is inferior and the durability on repeated impact is also inferior.

In Comparative Example 2, the value of C×(Cs−Cc) is smaller than 132.0, and the specific gravity of the intermediate layer material is smaller than 1.05. As a result, the distance on shots with the driver (W #1, HS 40 m/s) is inferior, and the durability on repeated impact is also inferior.

In Comparative Example 3, the value of C×(Cs−Cc) is smaller than 132.0, the difference in hardness (Cs−Cc) between the core surface hardness and the core center hardness is smaller than 30 on the Shore C hardness scale, and the specific gravity of the intermediate layer material is smaller than 1.05. As a result, the durability on repeated impact is inferior.

In Comparative Example 4, the value of C×(Cs−Cc) is smaller than 132.0. As a result, on shots with the utility club, the number six iron (I #6, HS 40 m/s), and the number eight iron (I #8), the distance is inferior.

In Comparative Example 5, the value of C×(Cs−Cc) is smaller than 132.0. As a result, on shots with the driver (W #1, HS 40 m/s), the utility club, the number six iron (I #6, HS 40 m/s), and the number eight iron (I #8), the distance is inferior.

In Comparative Example 6, the value of C×(Cs−Cc) is smaller than 132.0, the value of Cs−Cc is smaller than 30 on the Shore C hardness scale, and the value of (surface area E+surface area F)−(surface area A+surface area B) in the core hardness profile is smaller than 3.0. As a result, the distance under all striking conditions is inferior.

In Comparative Example 7, the value of C×(Cs−Cc) is smaller than 132.0, the value of Cs−Cc is smaller than 30 on the Shore C hardness scale, and the value of (surface area E+surface area F)−(surface area A+surface area B) in the core hardness profile is smaller than 3.0. As a result, on shots with each of the driver (W #1, HS 35 m/s) and the number six iron (I #6, HS 40 m/s), the distance is inferior.

In Comparative Example 8, the value of C×(Cs−Cc) is smaller than 132.0, the value of Cs−Cc is smaller than 30 on the Shore C hardness scale, and the value of (surface area E+surface area F)−(surface area A+surface area B) in the core hardness profile is smaller than 3.0. As a result, on shots with each of the driver (W #1, HS 40 m/s) and the number six iron (I #6, HS 40 m/s), the distance is inferior.

Japanese Patent Application No. 2022-167552 is incorporated herein by reference. Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A multi-piece solid golf ball comprising a core, an intermediate layer, and a cover, wherein the core is formed of a rubber composition in a single layer or a plurality of layers, the intermediate layer and the cover are both formed of a resin composition, a specific gravity of the intermediate layer is at least 1.05, and the core has a hardness profile in which, letting a Shore C hardness at a core center be Cc, a Shore C hardness at a midpoint M between the core center and a core surface be Cm, respective Shore C hardnesses at positions 2 mm, 4 mm, and 6 mm inward from the midpoint M be Cm−2, Cm−4, and Cm−6, and respective Shore C hardnesses at positions 2 mm, 4 mm, and 6 mm outward from the midpoint M be Cm+2, Cm+4, and Cm+6, and a Shore C hardness at the core surface be Cs, and defining surface areas A to F as follows:

surface area A: ½×2×(Cm−4−Cm−6)
surface area B: ½×2×(Cm−2−Cm−4)
surface area C: ½×2×(Cm−Cm−2)
surface area D: ½×2×(Cm+2−Cm)
surface area E: ½×2×(Cm+4−Cm+2)
surface area F: ½×2×(Cm+6−Cm+4)

the following condition is satisfied:

$$(\text{surface area } E+\text{surface area } F)-(\text{surface area } A+\text{surface area } B)\geq 3.0$$

and letting a deflection (mm) when the core is compressed under a final load of 1,275 N (130 kgf) from an initial load of 98 N (10 kgf) be C (mm), the following two conditions are satisfied:

$$Cs-Cc\geq 28.0$$

$$C\times(Cs-Cc)\geq 132.0.$$

2. The multi-piece solid golf ball of claim 1, wherein the following condition is satisfied:

$$(Cs-Cc)/(Cm-Cc)\geq 4.0.$$

3. The multi-piece solid golf ball of claim 1, wherein, letting the deflection (mm) when a ball is compressed under a final load of 1,275 N (130 kgf) from an initial load of 98 N (10 kgf) be B (mm), the following two conditions are satisfied:

$$B\geq 2.80$$

$$C-B\geq 1.00.$$

4. The multi-piece solid golf ball of claim 1, wherein a relationship between a core surface hardness, a surface hardness of a sphere (intermediate layer-encased sphere) in which the core is encased with the intermediate layer, and a surface hardness of a sphere (ball) in which the intermediate layer-encased sphere is encased with the cover satisfies the following condition:

$$\text{ball surface hardness} < \text{surface hardness of intermediate layer-encased sphere} > \text{core surface hardness}$$

(where the surface hardness of each sphere means Shore C hardness).

5. The multi-piece solid golf ball of claim 1, wherein the resin composition of the intermediate layer contains a high-acid ionomer resin having an acid content of at least 16 wt %.

6. The multi-piece solid golf ball of claim 1, wherein the intermediate layer contains an inorganic particulate filler.

7. The multi-piece solid golf ball of claim 1, wherein a difference between a specific gravity of the cover and the specific gravity of the intermediate layer is not more than 0.15, and a difference between the specific gravity of the intermediate layer and a specific gravity of the core is not more than 0.15.

8. The multi-piece solid golf ball of claim 1, wherein the following condition is satisfied:

cover thickness<intermediate layer thickness.

9. The multi-piece solid golf ball of claim 1, wherein the core is formed of a rubber composition containing the following components (A) to (E):

(A) a base rubber, (B) an organic peroxide, (C) water or a monocarboxylic acid metal salt, (D) sulfur, and (E) an organosulfur compound.

10. The multi-piece solid golf ball of claim 9, wherein a content ratio of the components (D) and (C) is 0.005 to 0.200 in a weight ratio of (D)/(C).

11. The multi-piece solid golf ball of claim 1, wherein a relationship between an initial velocity of the entire core, an initial velocity of a sphere (intermediate layer-encased sphere) in which the core is encased with the intermediate layer, and an initial velocity of a sphere (ball) in which the intermediate layer-encased sphere is encased with the cover satisfies the following two conditions:

(initial velocity of ball)<(initial velocity of intermediate layer-encased sphere)

0.65≤(initial velocity of intermediate layer-encased sphere)−(initial velocity of entire core)≤0.98 (m/s).

12. A multi-piece solid golf ball comprising a core, an intermediate layer, and a cover, wherein the core is formed of a rubber composition into a single layer or a plurality of layers, the intermediate layer and the cover are both formed of a resin composition, and a relationship between a core surface hardness, a surface hardness of a sphere (intermediate layer-encased sphere) obtained by encasing the core with the intermediate layer, and a surface hardness of a sphere (ball) obtained by encasing the intermediate layer-encased sphere with the cover satisfies the following condition:

ball surface hardness<surface hardness of intermediate layer-encased sphere>core surface hardness (where the surface hardness of each sphere means Shore C hardness)

and the core has a hardness profile in which, letting a Shore C hardness at a core center be Cc, a Shore C hardness at a midpoint M between the core center and a core surface be $C_m$, respective Shore C hardnesses at positions 2 mm, 4 mm, and 6 mm inward from the midpoint M be Cm−2, Cm−4, and Cm−6, respective Shore C hardnesses at positions 2 mm, 4 mm, and 6 mm outward from the midpoint M be Cm+2, Cm+4, and Cm+6, and a Shore C hardness at the core surface be Cs, and defining surface areas A to F as follows:

surface area A: ½×2×(Cm−4−Cm−6)

surface area B: ½×2×(Cm−2−Cm−4)

surface area C: ½×2×(Cm−Cm−2)

surface area D: ½×2×(Cm+2−Cm)

surface area E: ½×2×(Cm+4−Cm+2)

surface area F: ½×2×(Cm+6−Cm+4)

the following condition is satisfied:

(surface area *E*+surface area *F*)−(surface area *A*+surface area *B*)≥3.0 and letting a deflection (mm) when the core is compressed under a final load of 1,275 N (130 kgf) from an initial load of 98 N (10 kgf) be C (mm), the following two conditions are satisfied:

$Cs-Cc \geq 28.0$ $C \times (Cs-Cc) \geq 132.0.$

13. The multi-piece solid golf ball of claim 12, wherein a relationship between an initial velocity of the entire core, an initial velocity of the sphere (intermediate layer-encased sphere) in which the core is encased with intermediate layer, and an initial velocity of the sphere (ball) in which the intermediate layer-encased sphere is encased with the cover satisfies the following two conditions:

(initial velocity of ball)<(initial velocity of intermediate layer-encased sphere)

0.65≤(initial velocity of intermediate layer-encased sphere)−(initial velocity of entire core)≤0.98 (m/s).

* * * * *